US011022915B2

(12) United States Patent
Kubota et al.

(10) Patent No.: US 11,022,915 B2
(45) Date of Patent: Jun. 1, 2021

(54) IMAGE FORMING APPARATUS WITH BELT UNIT HAVING CLEANING UNIT

(71) Applicant: CANON KABUSHIKI KAISHA, Tokyo (JP)

(72) Inventors: Hitoshi Kubota, Tokyo (JP); Yasuhiro Shimoi, Toride (JP); Hiroki Takayama, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/426,396

(22) Filed: May 30, 2019

(65) Prior Publication Data

US 2019/0369530 A1 Dec. 5, 2019

(30) Foreign Application Priority Data

Jun. 5, 2018 (JP) ..... JP2018-108093
Jun. 21, 2018 (JP) ..... JP2018-118301
Jun. 22, 2018 (JP) ..... JP2018-118715

(51) Int. Cl.
*G03G 15/16* (2006.01)
*G03G 15/08* (2006.01)
*G03G 15/02* (2006.01)

(52) U.S. Cl.
CPC ..... *G03G 15/1615* (2013.01); *G03G 15/0225* (2013.01); *G03G 15/0808* (2013.01); *G03G 15/161* (2013.01)

(58) Field of Classification Search
CPC .. G03G 15/161; G03G 15/1615; G03G 21/10; G03G 21/105; G03G 21/1642; G03G 21/1647; G03G 2215/00143
See application file for complete search history.

(56) References Cited

U.S. PATENT DOCUMENTS 7,194,230 B2 3/2007 Haruyama
7,392,007 B2 6/2008 Nakano et al.
9,213,301 B2 12/2015 Kudo et al.

FOREIGN PATENT DOCUMENTS

JP 1-191885 A 8/1989
JP 01191884 A * 8/1989
JP 2005-121800 A 5/2005
JP 2005-300873 A 10/2005
JP 2009-300859 A 12/2009
JP 2015-064503 A 4/2015
JP 2017-015982 A 1/2017
JP 2018-004773 A 1/2018

* cited by examiner

*Primary Examiner* — Walter L Lindsay, Jr.
*Assistant Examiner* — Andrew V Do
(74) *Attorney, Agent, or Firm* — Venable LLP

(57) ABSTRACT

An image forming apparatus includes a belt unit including an endless belt, a supporting unit and a steering unit, and further includes a cleaning unit, a receiving opening and a communicating portion. The communicating portion includes a tube-shaped portion constituted by a bellows-shaped elastic member capable of expansion and contraction with movement of the steering unit.

6 Claims, 24 Drawing Sheets

(a)

(b)

(c)

(a)

(b)

IMAGE FORMING APPARATUS WITH BELT UNIT HAVING CLEANING UNIT

FIELD OF THE INVENTION AND RELATED ART

The present invention relates to an image forming apparatus, such as a copying machine, a printer or a facsimile machine, using an electrophotographic type or an electrostatic recording type.

Conventionally, in the image forming apparatus of an electrophotographic type or an electrostatic recording type, the belt feeding device including the endless belt stretched by the plurality of stretching rollers is used. The belt is used as a feeding member for carrying and feeding a toner image or carrying and feeding a recording material on which the toner image is formed. As the feeding member for carrying and feeding the toner image, an intermediary transfer member (intermediary transfer belt) for carrying and feeding the toner image in order to transfer the toner image from the photosensitive member onto the recording material, a belt-shaped electrophotographic photosensitive member (photosensitive belt), a belt-shaped electrostatic recording dielectric member, and the like member are used. Further, as the feeding member for carrying and feeding the recording material on which the toner image is formed, a recording material feeding member (recording material feeding belt) for carrying and feeding the recording material onto which the toner image is transferred from the photosensitive member is used.

In such a belt feeding device, a "belt shift" such that the belt shifts toward an end portion side of either of stretching rollers with respect to a rotational axis direction during feeding (traveling) of the belt due to accuracy of outer diameters of the stretching rollers, accuracy of relative alignment between the respective stretching rollers, and the like occurs. For that reason, a steering mechanism in which a force for swinging (tilting) the steering belt by a slidable member slidable with an inner peripheral surface of a rotating belt at each of end portions with respect to a widthwise direction of the belt is imparted to the steering roller, and center alignment (adjustment of a belt feeding position with respect to a widthwise direction) of the belt is carried out, is provided in some instances. In this steering mechanism, the steering roller is capable of automatically carrying out the center alignment of the belt by a balance of a frictional force "automatic belt center alignment"). Further, a steering mechanism, in which an end portion position of a belt with respect to a widthwise direction is detected by a sensor and a steering roller is swung by an actuator depending on a detection result thereof, has also been known.

Further, the belt feeding device is provided with a cleaning device for removing toner from the belt by a cleaning blade or the like in some instances. The toner accommodated in the cleaning device is fed and collected in a collecting portion such as a collecting container or the like provided in an apparatus main assembly of the image forming apparatus. Incidentally, deposited matter on the belt removed from the belt by the cleaning device includes paper powder or the like in addition to the toner in some instances, but herein the toner as principal deposited matter will be representatively described.

Japanese Laid-Open Patent Application (JP-A) 2015-64503 discloses a constitution of a delivering portion of toner from a cleaning device toward a collecting portion provided in an apparatus main assembly in an image forming apparatus in which an automatic belt center alignment is employed and the cleaning device is swingable together with a steering roller. In the constitution of JP-A 2015-64503, a path member which is connected and integrally swingable with the cleaning device and configured to communicate a toner discharge opening of the cleaning device and an opening of a collecting container provided in the apparatus main assembly with each other is provided. The path member includes a nozzle portion communicating with the toner discharge opening. Further, the path member includes a cylindrical portion inserted so that the nozzle portion overlaps with the toner discharge opening through the opening with respect to a height direction in a non-contact state. As a result, the path member is not only swingable together with a steering unit but also intended so as not to prevent swing of the steering unit.

However, in the constitution of JP-A 2015-64503, the path member is a rigid member. In this case, in consideration of a movable region of the path member swingable together with the steering unit, in order to prevent the path member from disconnecting from the collecting container provided in the apparatus main assembly through the opening, there is a need that the path member be provided with an extended portion where a length of the path member is extended. Further, there is a need that a receiving member, in which the extended portion is accommodatable, be provided below the opening of the collecting container provided in the apparatus main assembly. For that reason, the constitution of the toner delivering portion from the cleaning device toward the collecting portion provided in the apparatus main assembly is upsized, so that there is possibility that the upsized toner delivering portion leads to upsizing of the image forming apparatus.

SUMMARY OF THE INVENTION

A principal object of the present invention is to provide an image forming apparatus capable of realizing downsizing of a constitution of a toner delivering portion from a cleaning device swingable together with a steering roller toward a collecting portion provided at a predetermined position.

According to an aspect of the present invention, there is provided an image forming apparatus comprising: a belt unit including an endless belt on which a toner image is formed, wherein the belt unit includes a supporting unit configured to rotatably support a first roller for stretching the belt and includes a steering unit which includes a second roller for stretching the belt and which is configured to rotatably support the second roller and to swingably support the second roller so that an angle of a rotational axis of the second roller relative to a rotational axis of the first roller is changeable, a cleaning unit provided in the steering unit and configured to remove toner remaining on the belt, the cleaning unit being provided with a discharge opening through which collected toner is discharged to an outside of the cleaning unit; a receiving opening through which the toner discharged through the discharge opening is received; and a communicating portion configured to establish communication between the discharge opening and the receiving opening, wherein the communicating portion includes a tube-shaped portion constituted by a bellows-shaped elastic member capable of expansion and contraction with movement of the steering unit.

Further features of the present invention will become apparent from the following description of exemplary embodiments with reference to the attached drawings.

Figure 4:
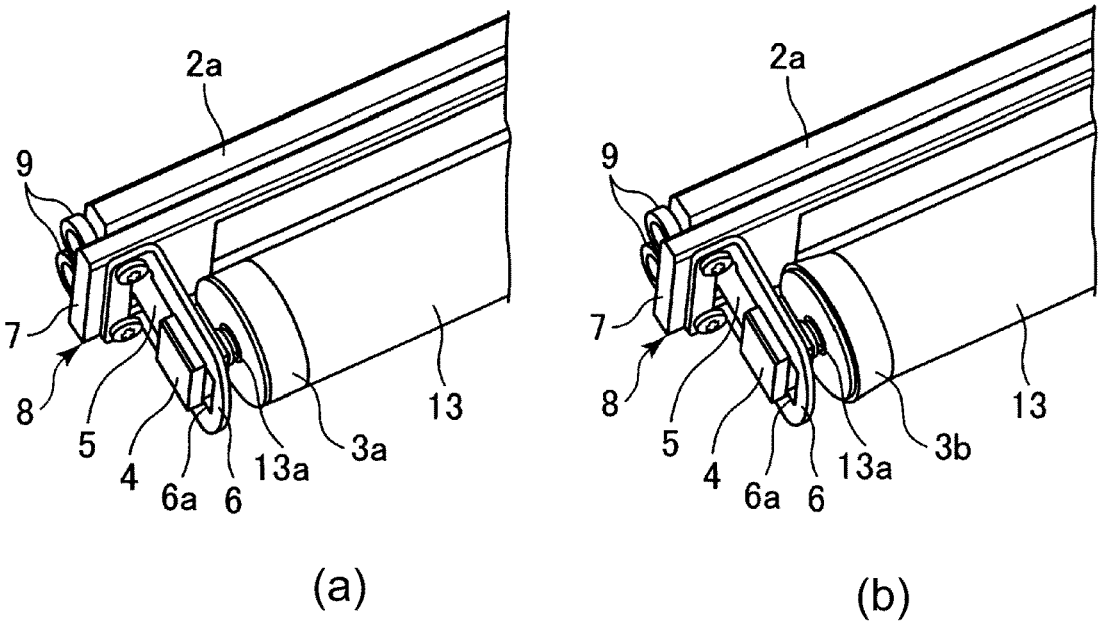

Parts (a) and (b) of FIG. 4 show examples of a sliding ring.

Figure 5:
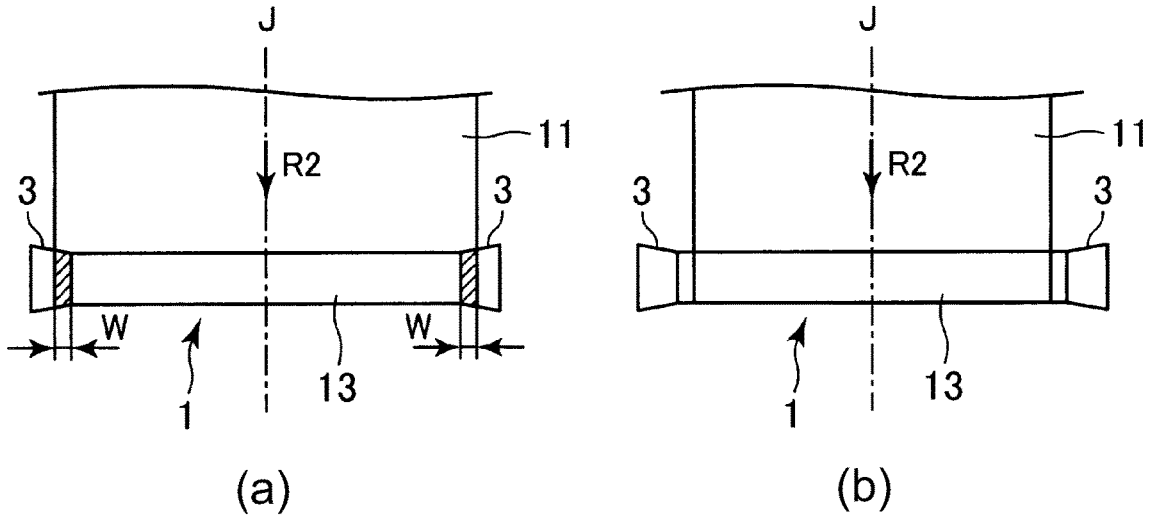

Parts (a) and (b) of FIG. 5 are schematic views for illustrating a bearing width between an intermediary transfer belt and the sliding rings.

Figure 6:
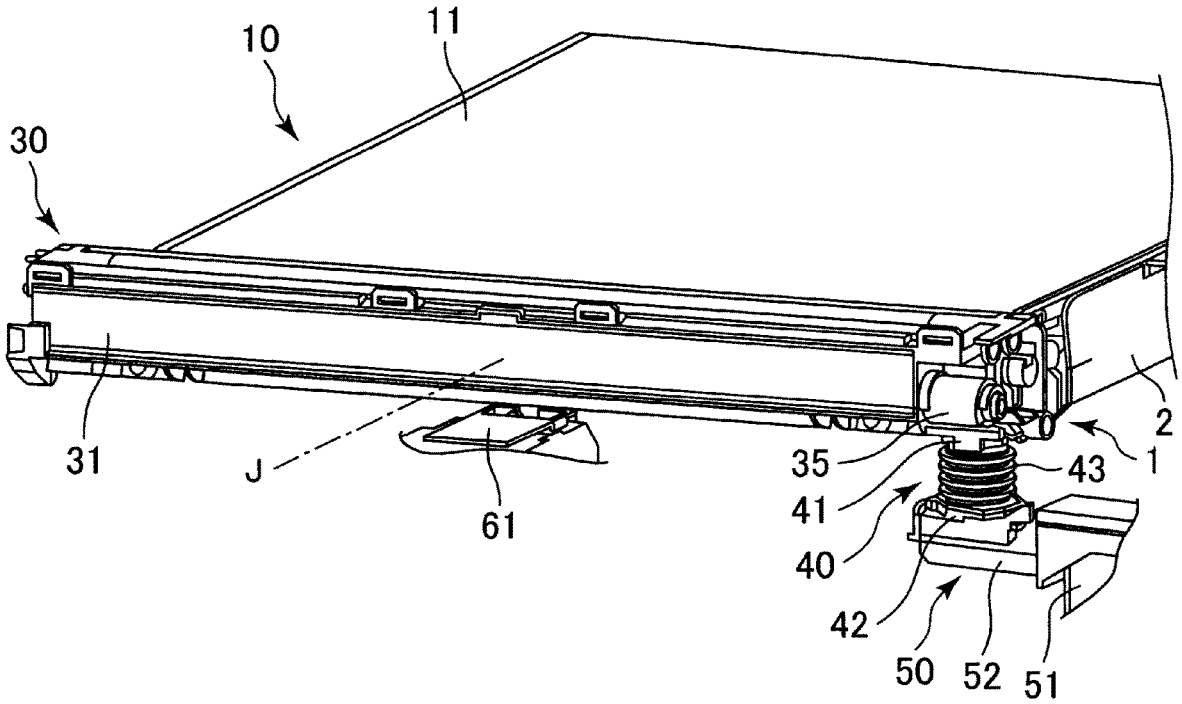

FIG. 6 is a perspective view of a belt unit and a neighborhood of the belt unit.

Figure 7:
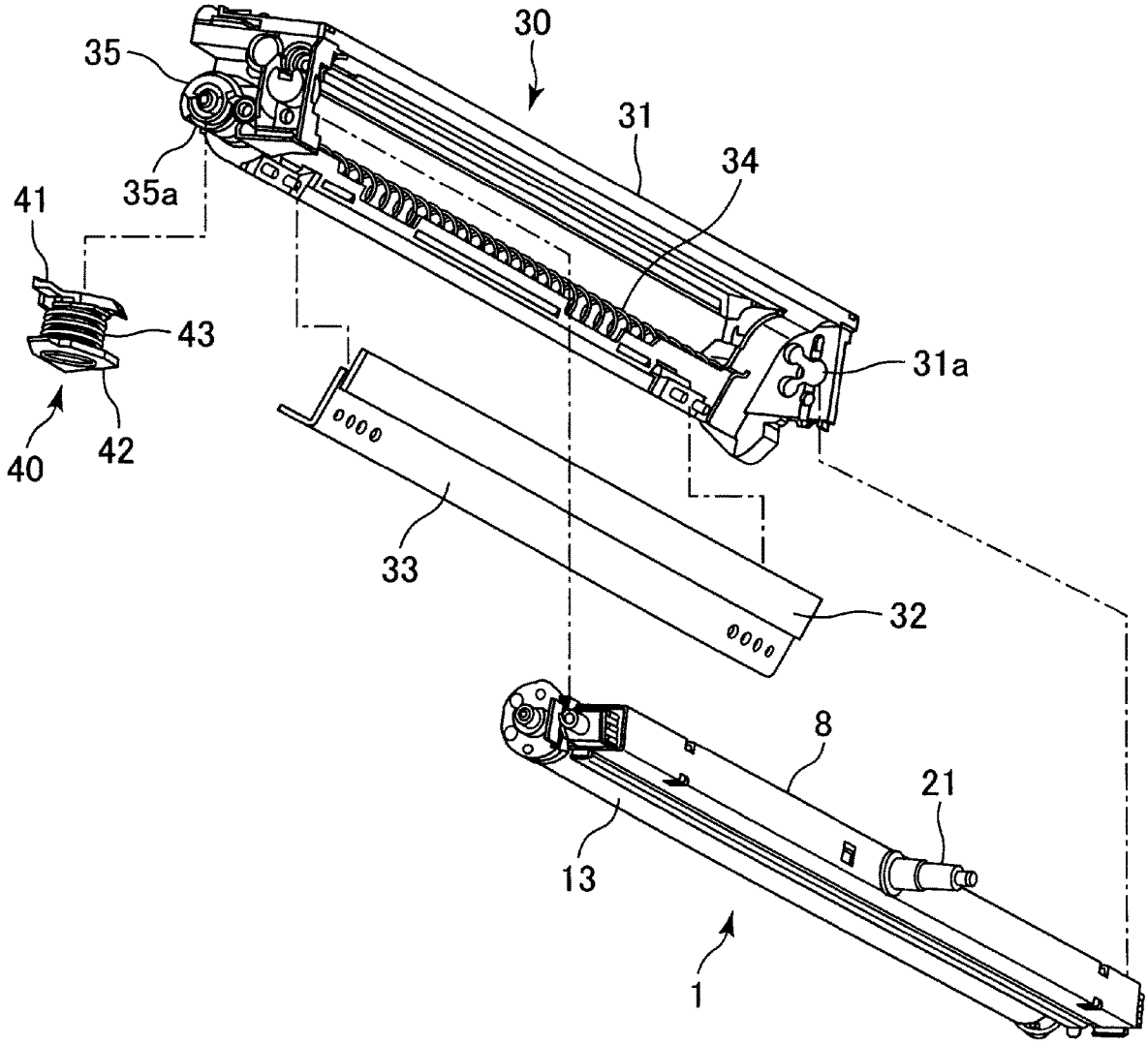

FIG. 7 is an exploded perspective view of a belt cleaning device and a peripheral portion thereof.

Figure 8:
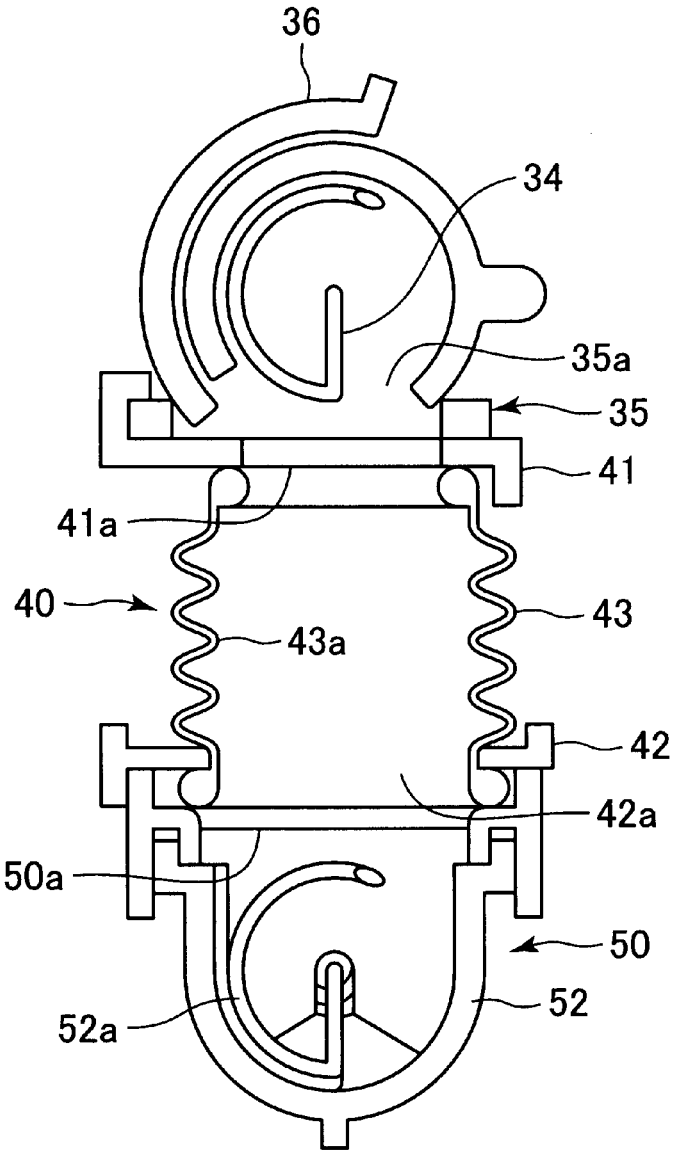

FIG. 8 is a schematic sectional view of a communicating member and a neighborhood thereof.

Figure 9:
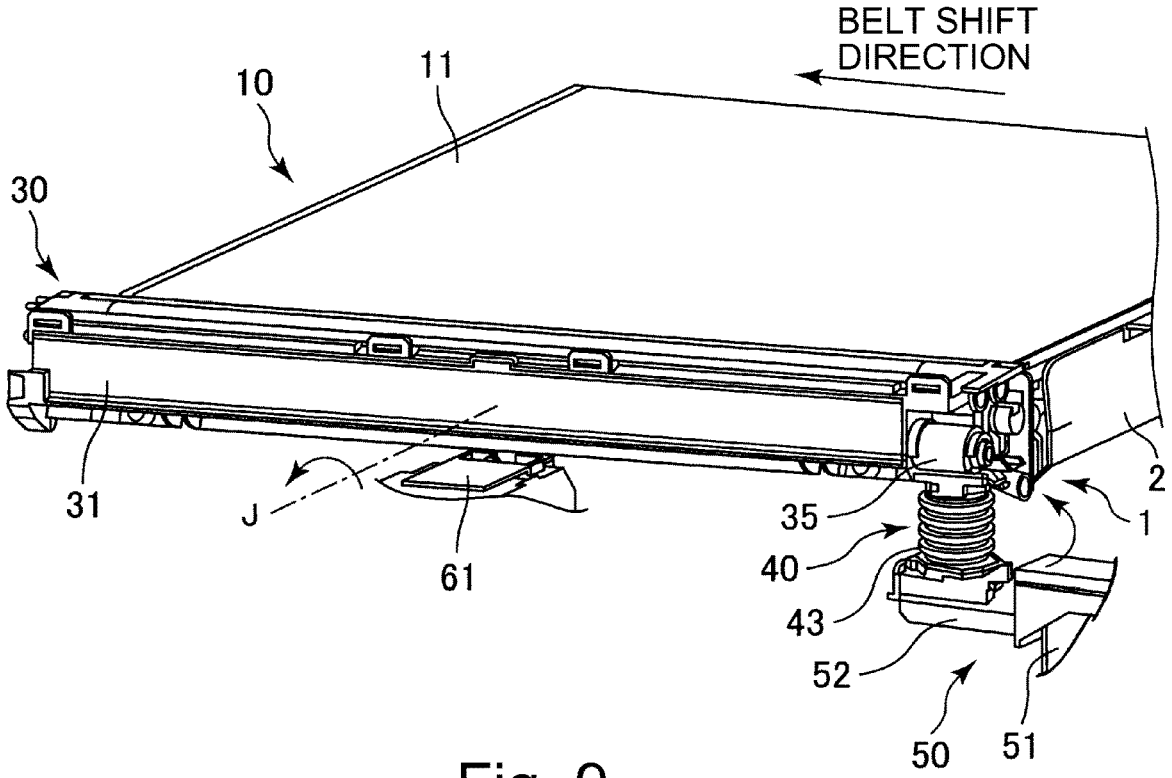

FIG. 9 is a perspective view showing a state in which the steering unit is swung and the communicating member is expanded.

Figure 10:
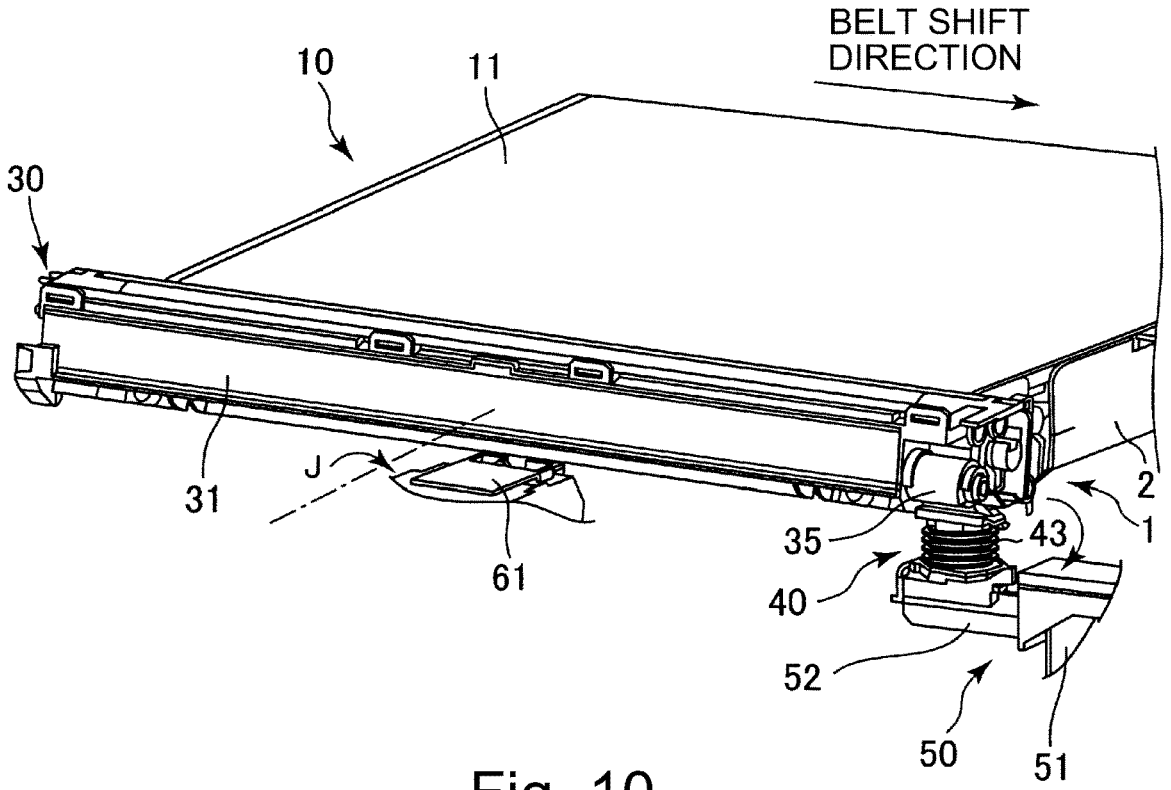

FIG. 10 is a perspective view showing a state in which the steering unit is swung and the communicating member is contracted.

Figure 11:
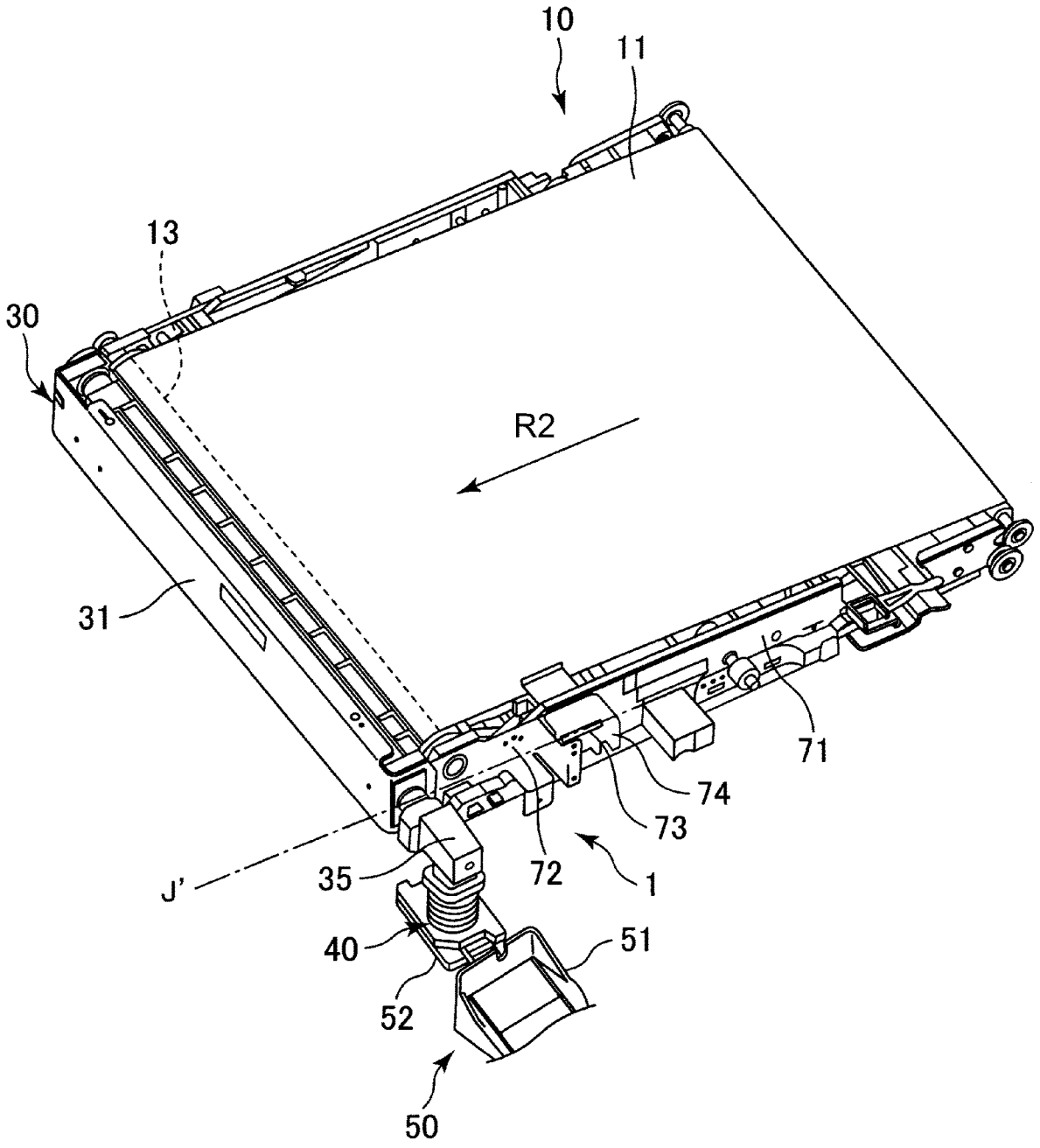

FIG. 11 is a perspective view of a belt unit in another embodiment and a neighborhood of the belt unit.

Figure 12:
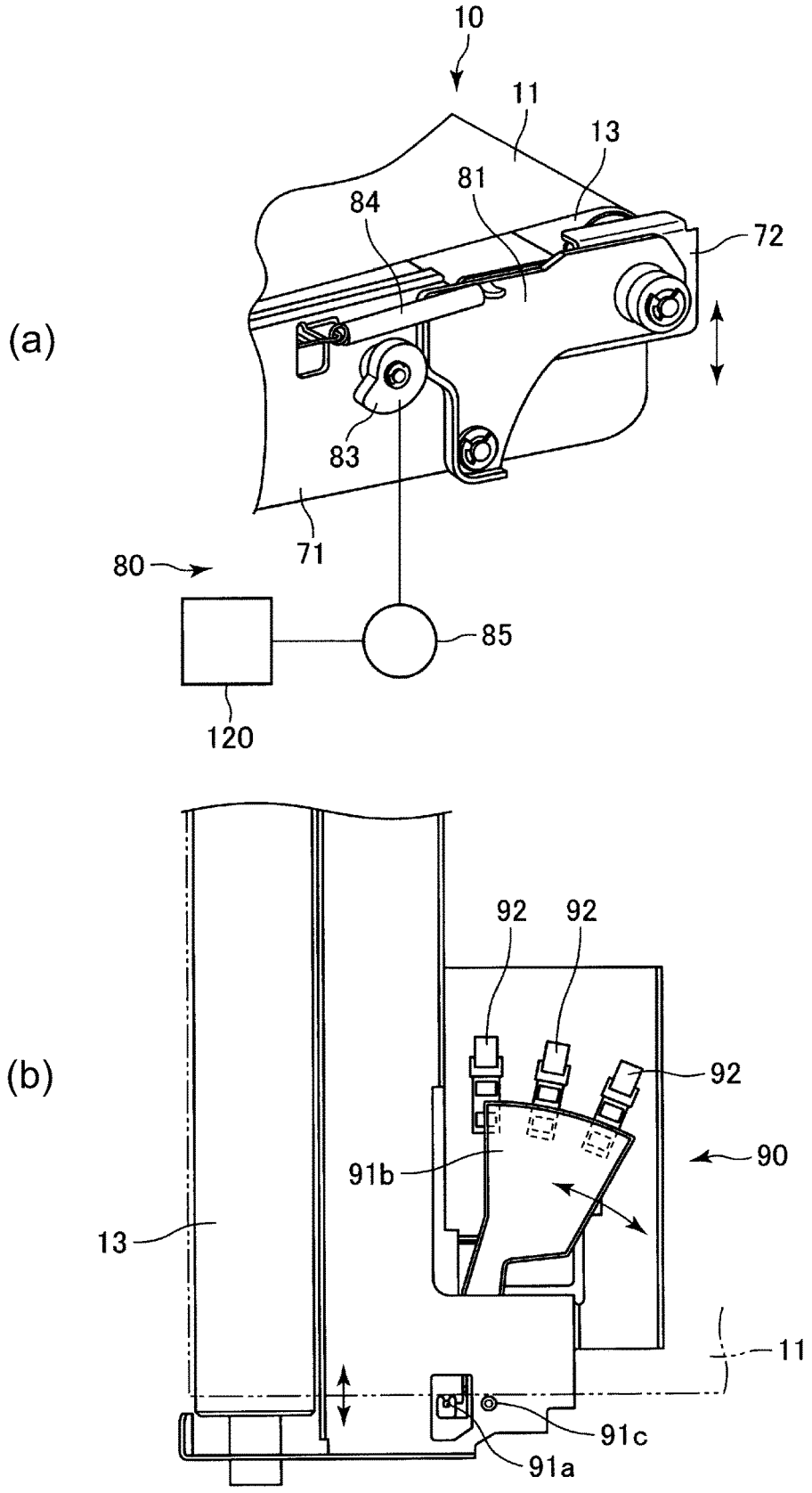

Parts (a) and (b) of FIG. 12 are schematic structural views for illustrating a sensor unit and a steering driving portion.

Figure 13:
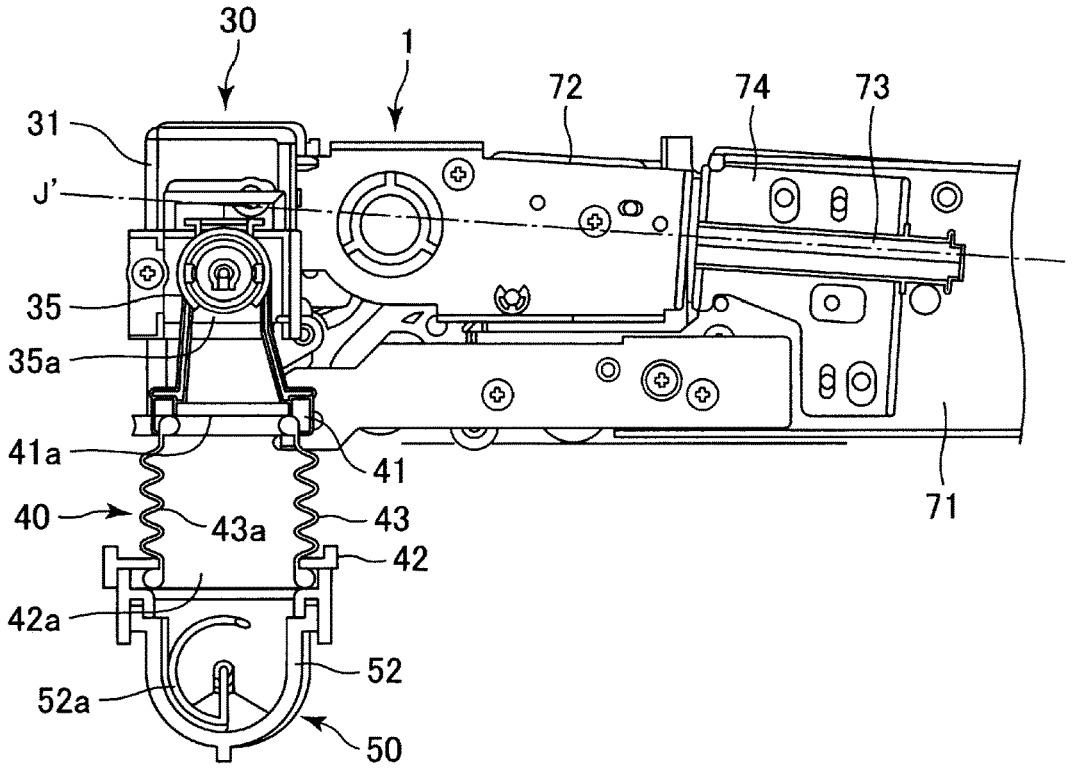

FIG. 13 is a sectional view of a communicating member in another embodiment described above and a neighborhood of the communicating member.

Figure 14:
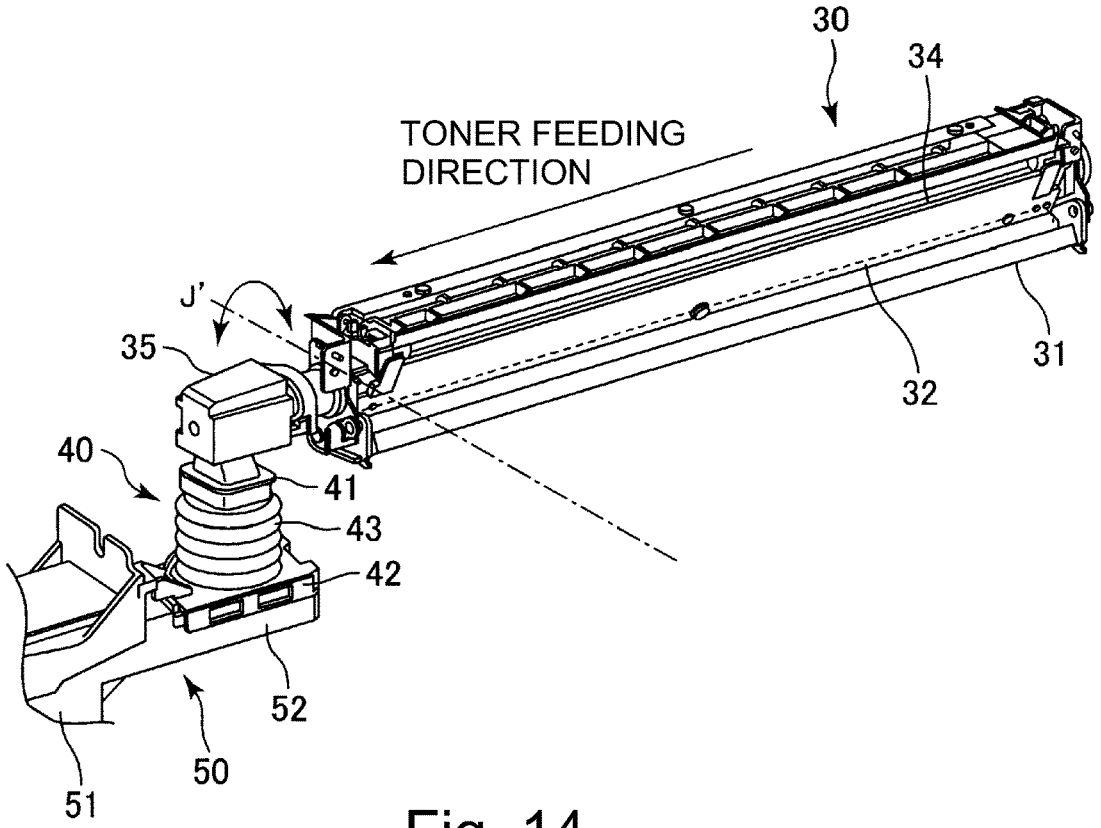

FIG. 14 is a perspective view of a belt cleaning device in another embodiment described above and a neighborhood of the belt cleaning device.

Figure 15:
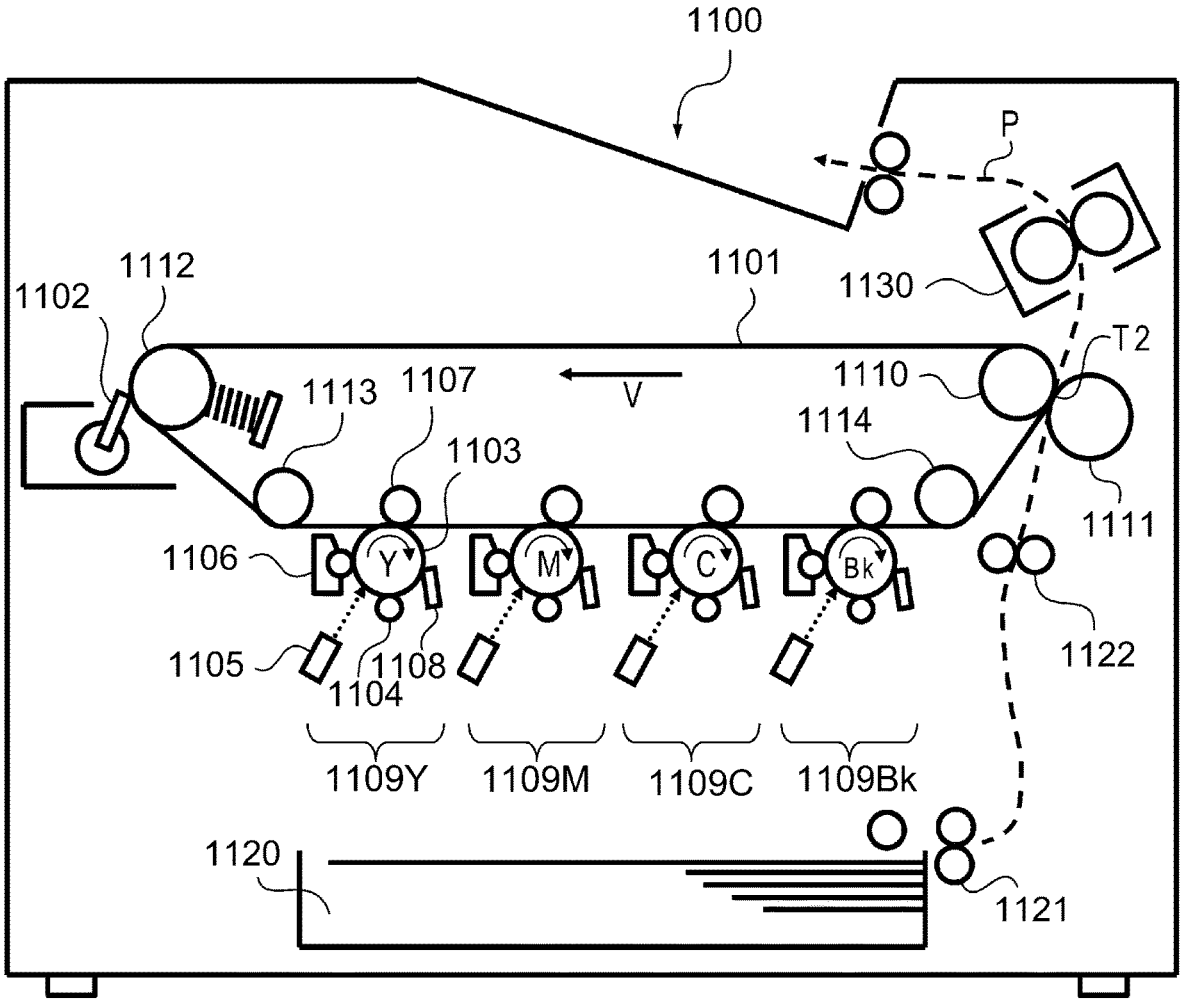

FIG. 15 is an illustration of an image forming apparatus.

Figure 16:
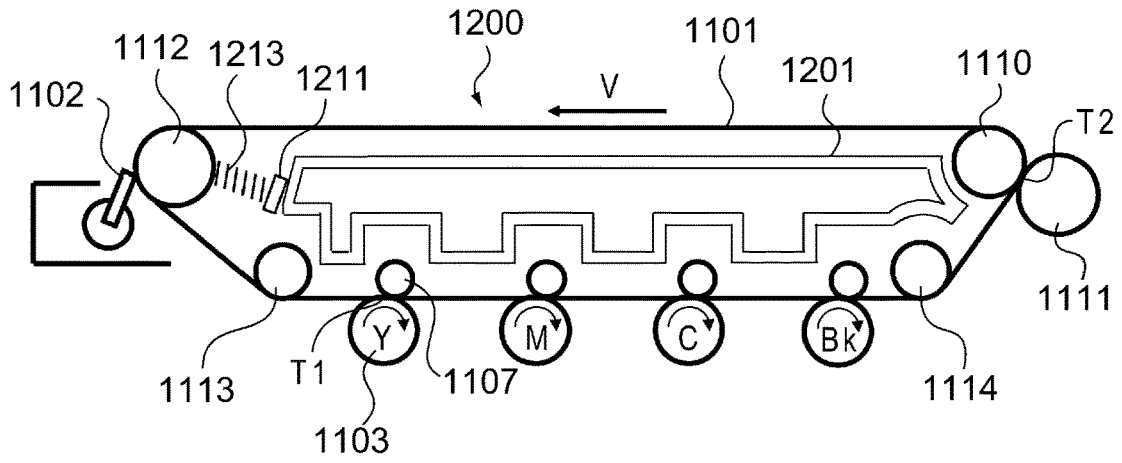
Figure 16:
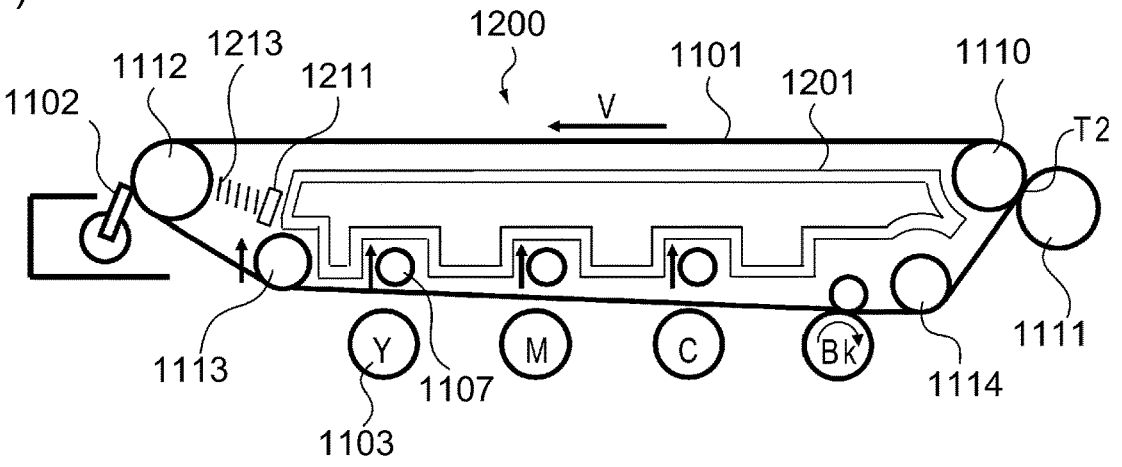
Figure 16:
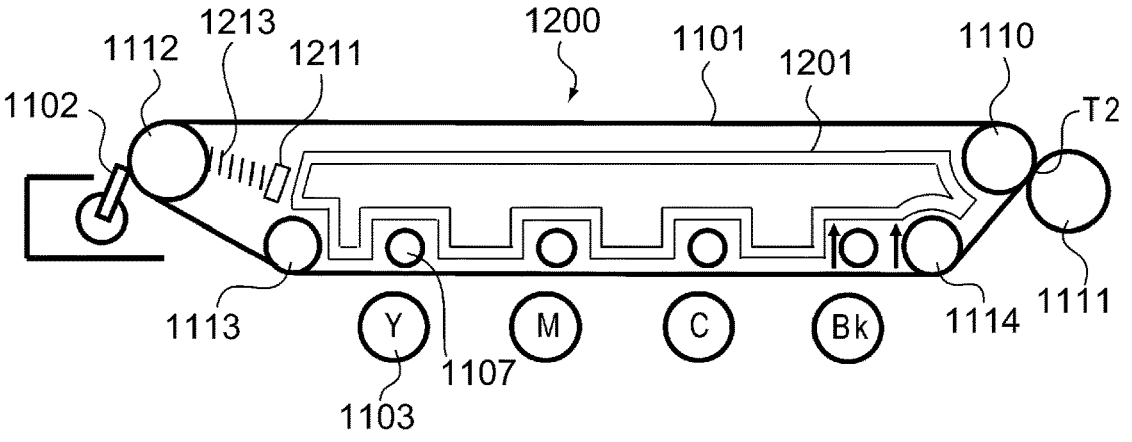

Parts (a), (b) and (c) of FIG. 16 are illustrations of an intermediary transfer unit.

Figure 17:
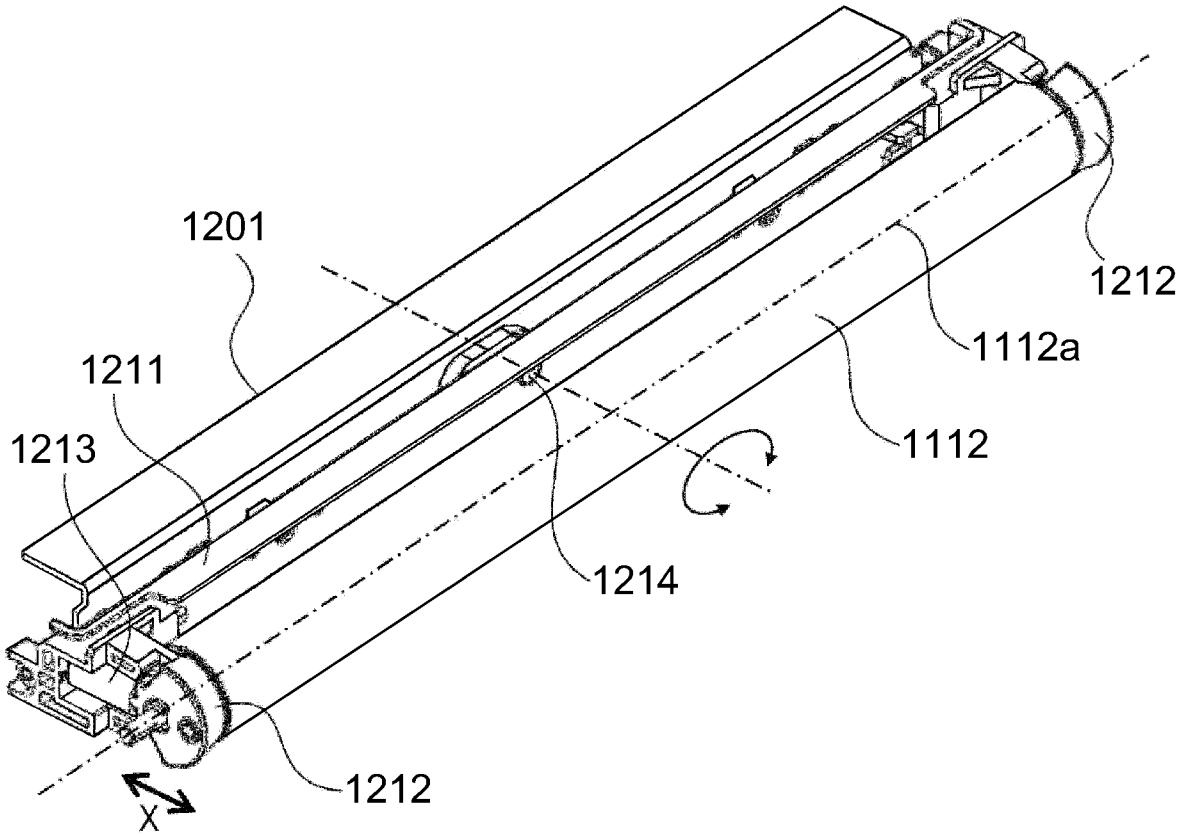

FIG. 17 is a perspective view of a steering mechanism.

Figure 18:
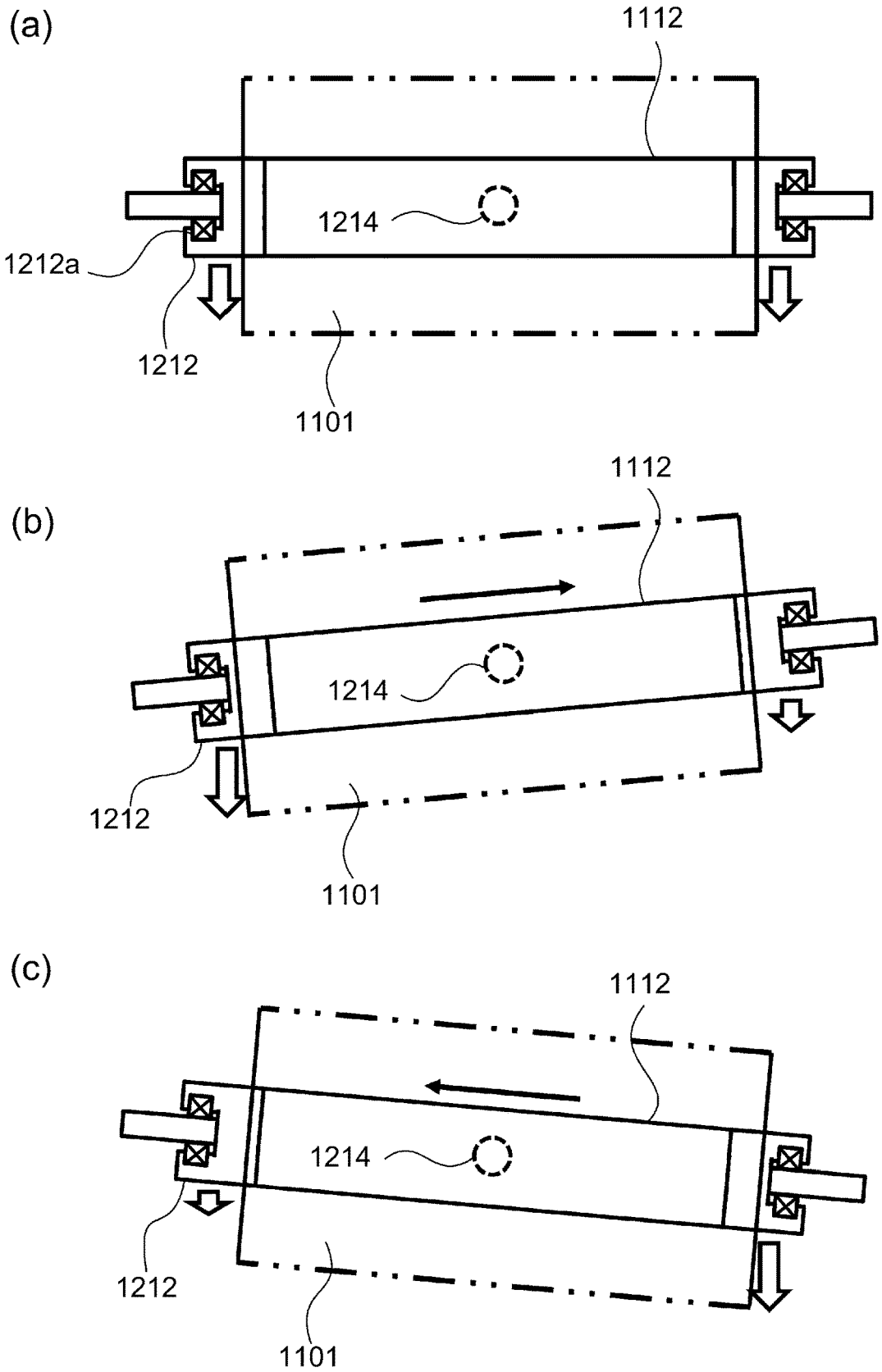

Parts (a), (b) and (c) of FIG. 18 are illustrations of an opening of the steering mechanism.

Figure 19:
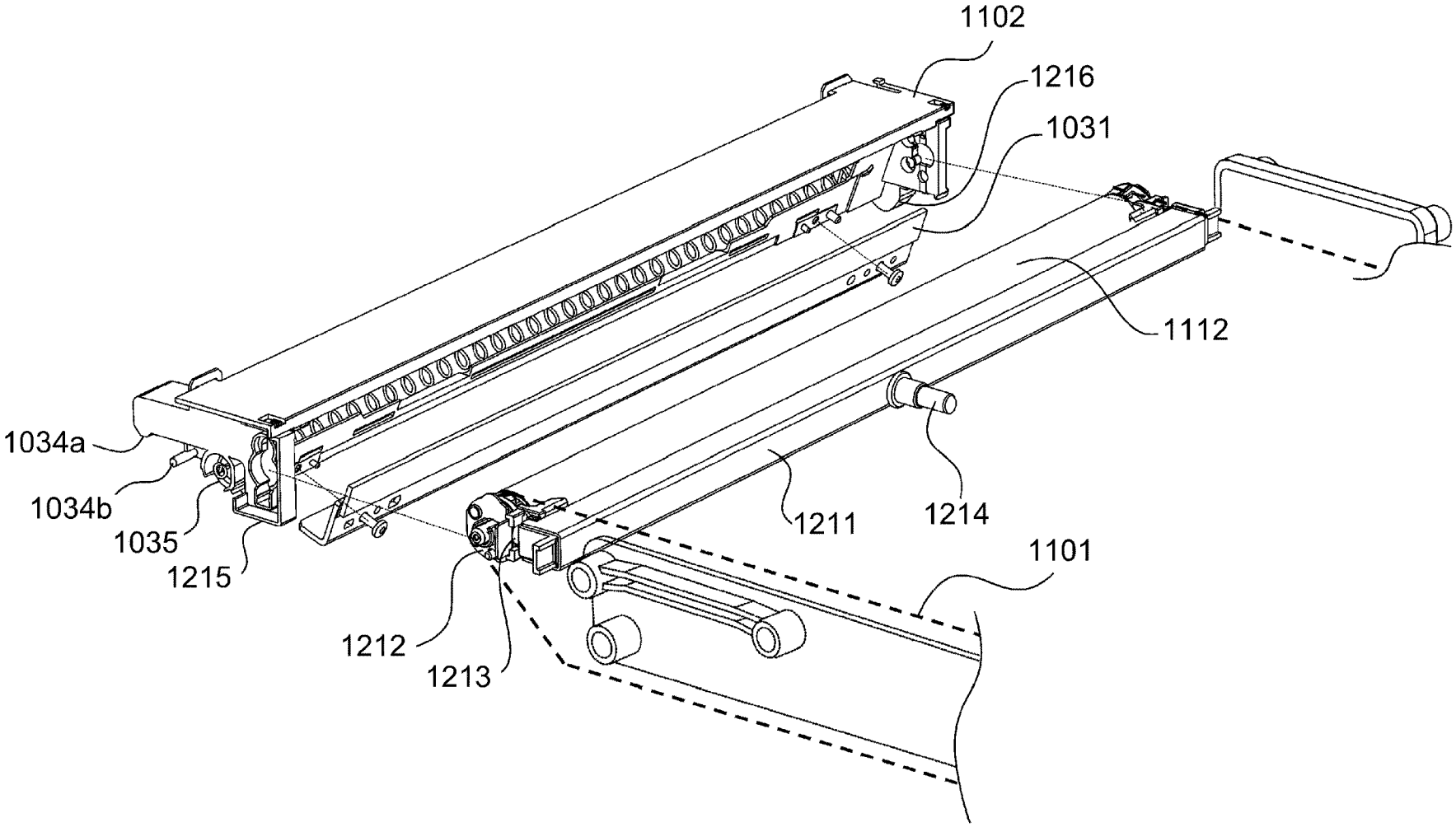

FIG. 19 is an illustration of a mounting state of an intermediary transfer belt cleaner unit.

Figure 20:
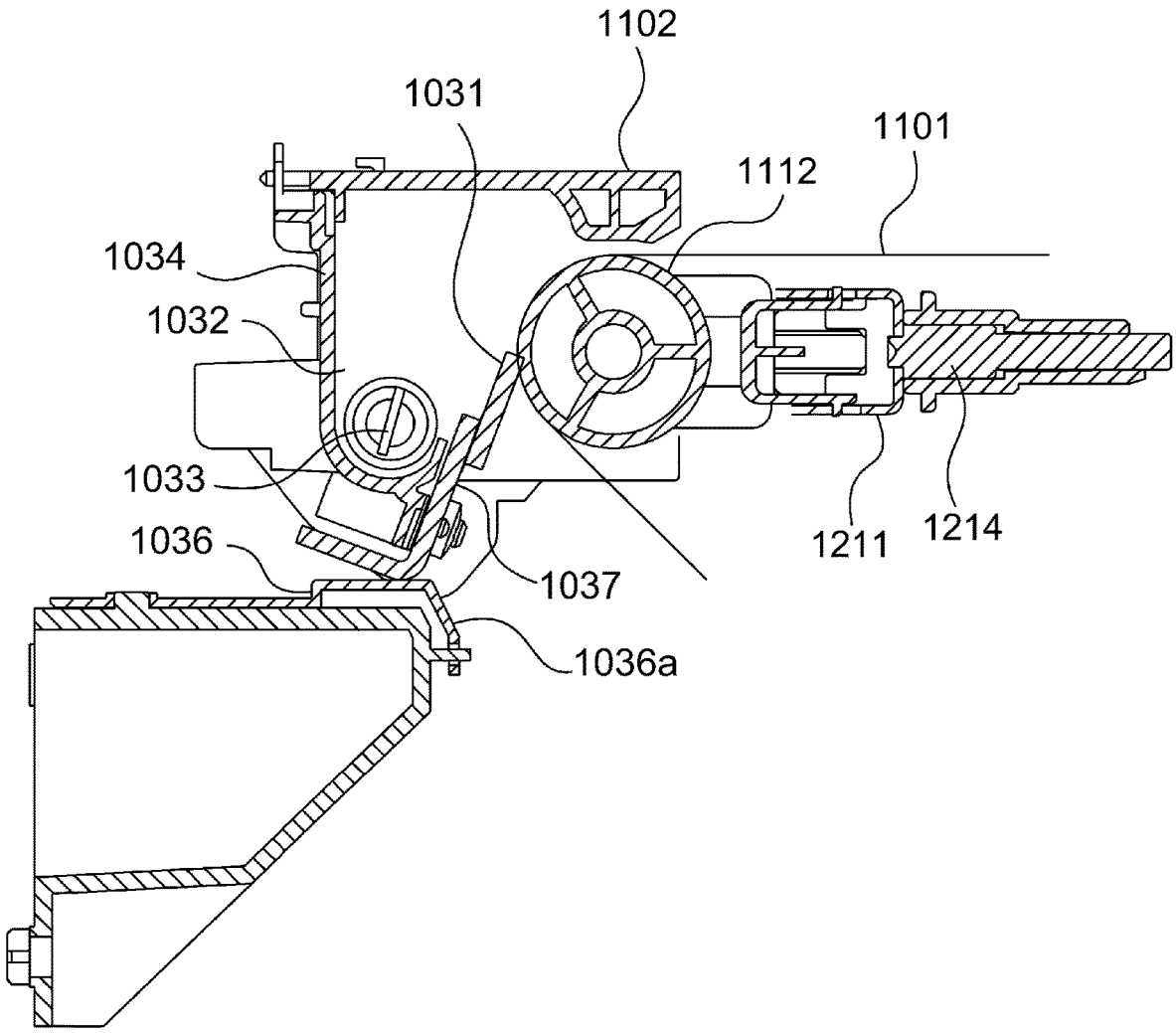

FIG. 20 is a sectional view of the intermediary transfer belt cleaner unit and a supporting portion.

Figure 21:
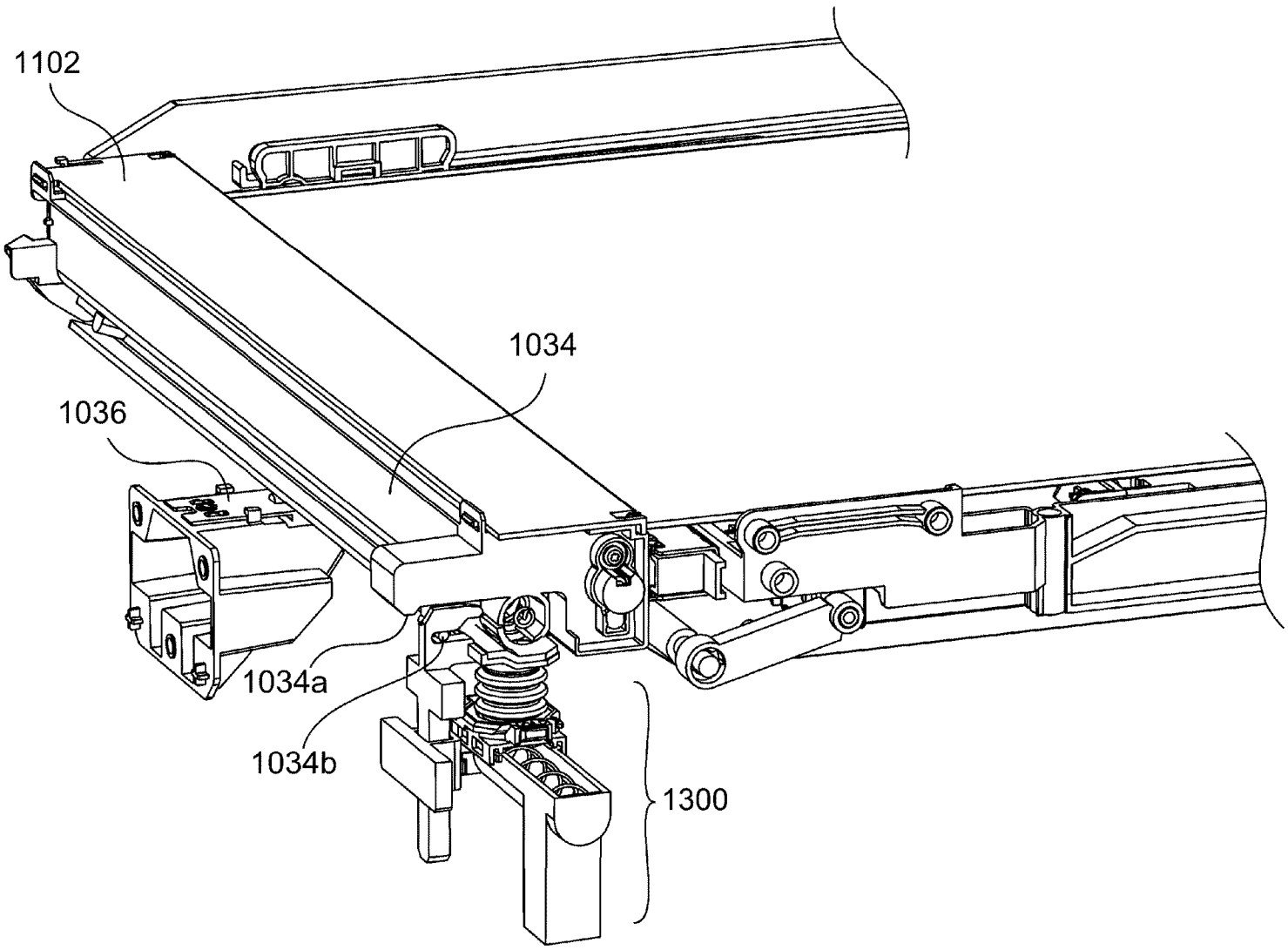

FIG. 21 is a perspective view of the intermediary transfer unit in a state in which the intermediary transfer unit is mounted in the image forming apparatus.

Figure 22:
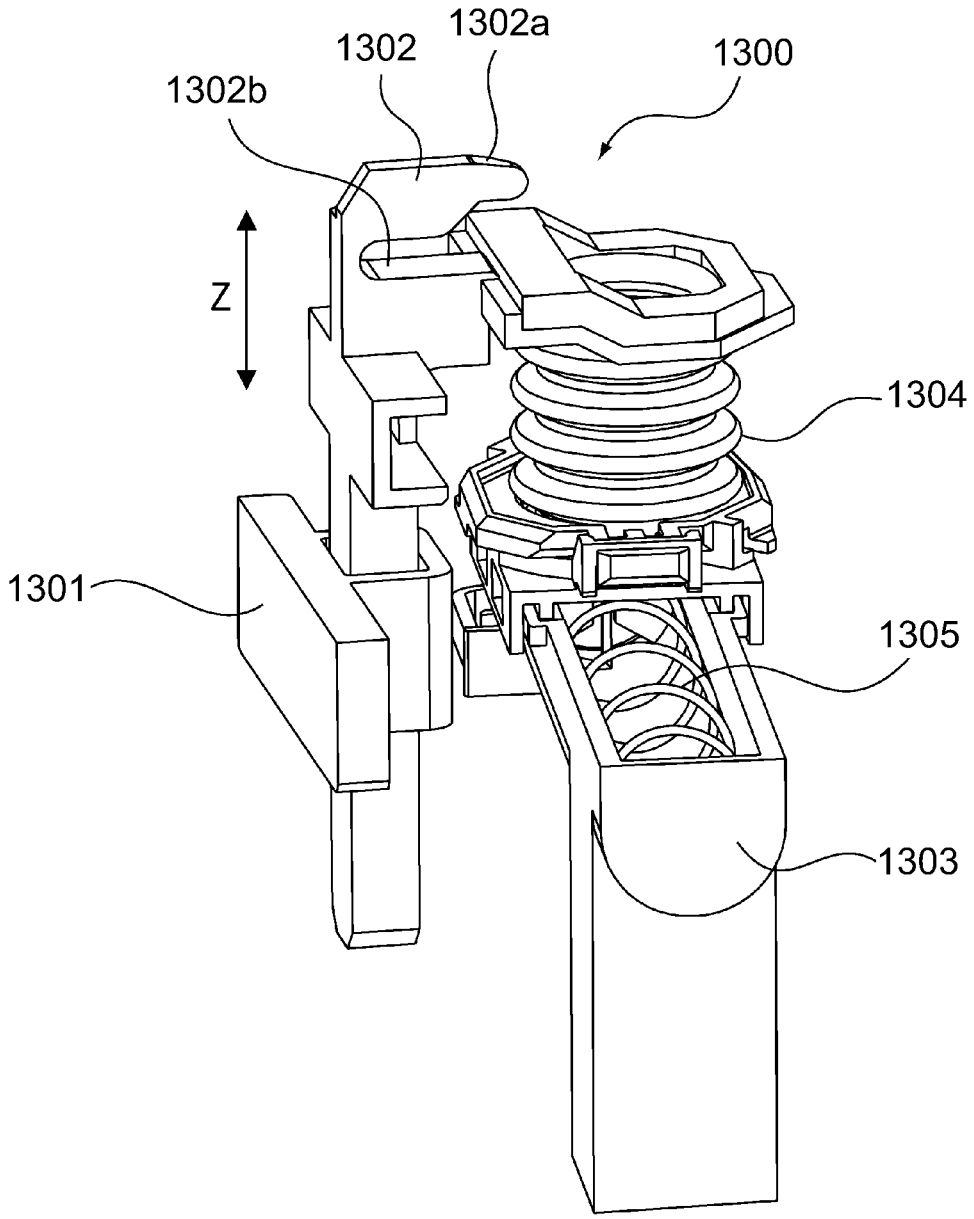

FIG. 22 is a perspective view of an intermediary feeding unit.

Figure 23:
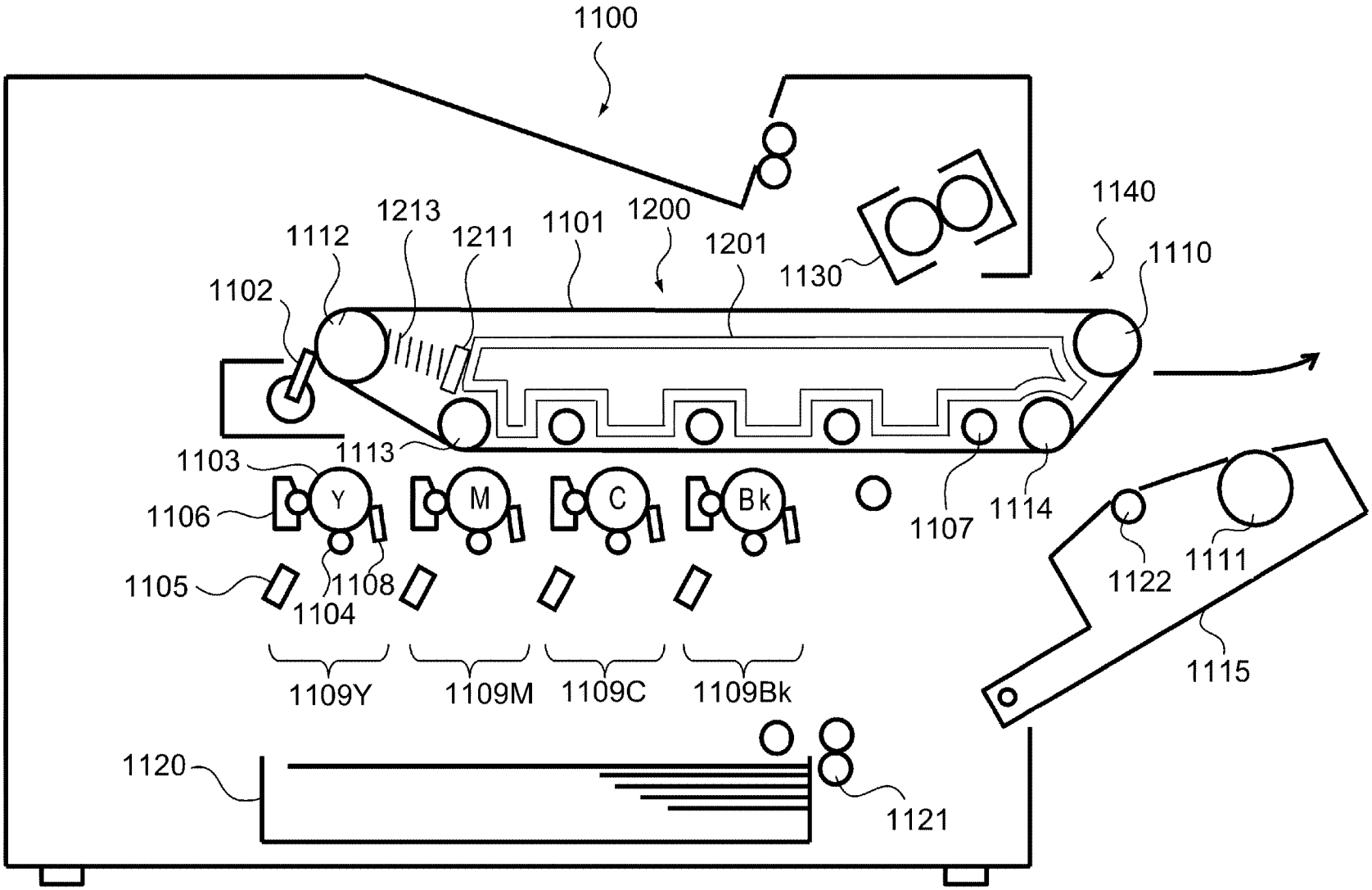

FIG. 23 is an illustration of the image forming apparatus from which the intermediary transfer unit is pulled out through an opening of the image forming apparatus.

Figure 24:
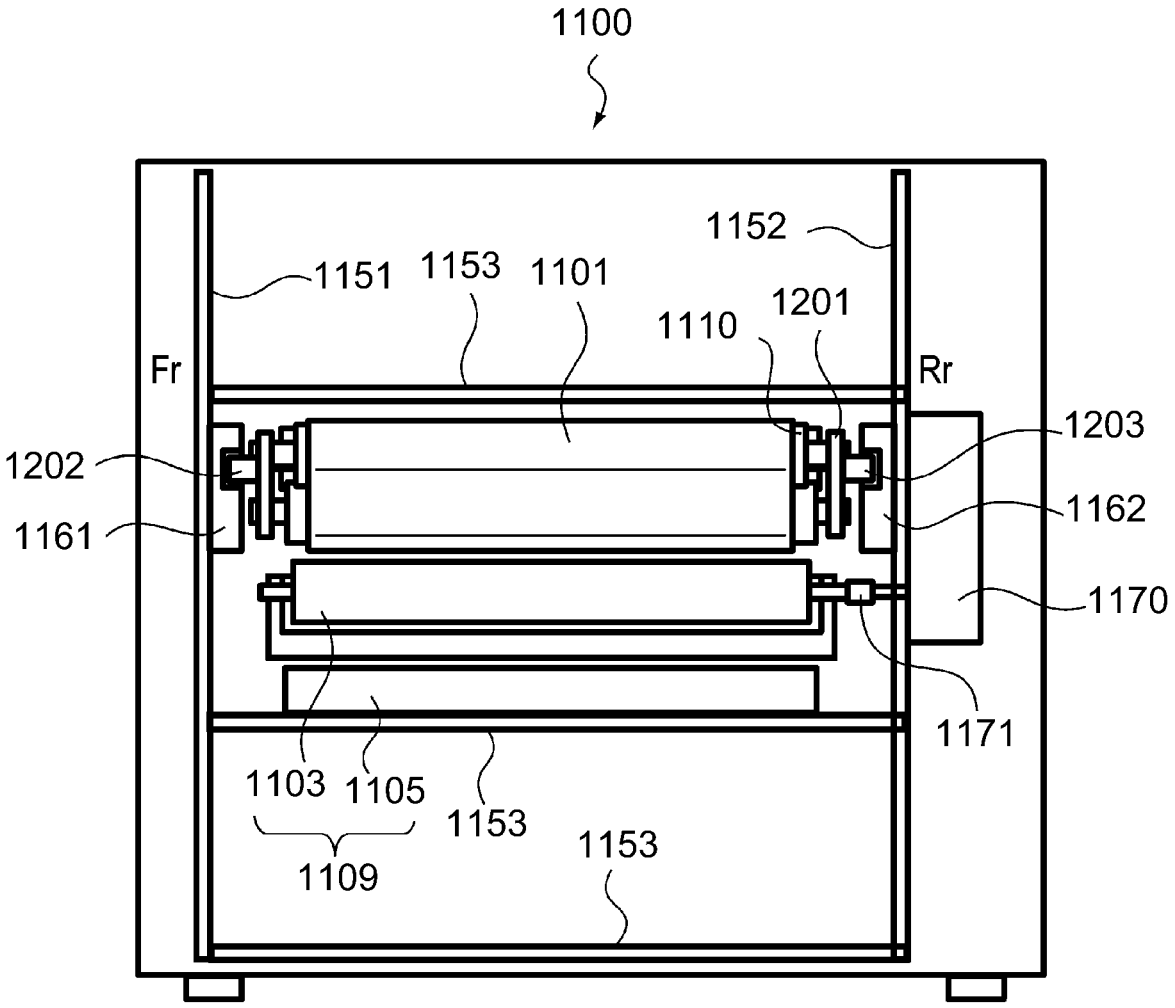

FIG. 24 is an illustration of a structure of side plates of the image forming apparatus.

Figure 25:
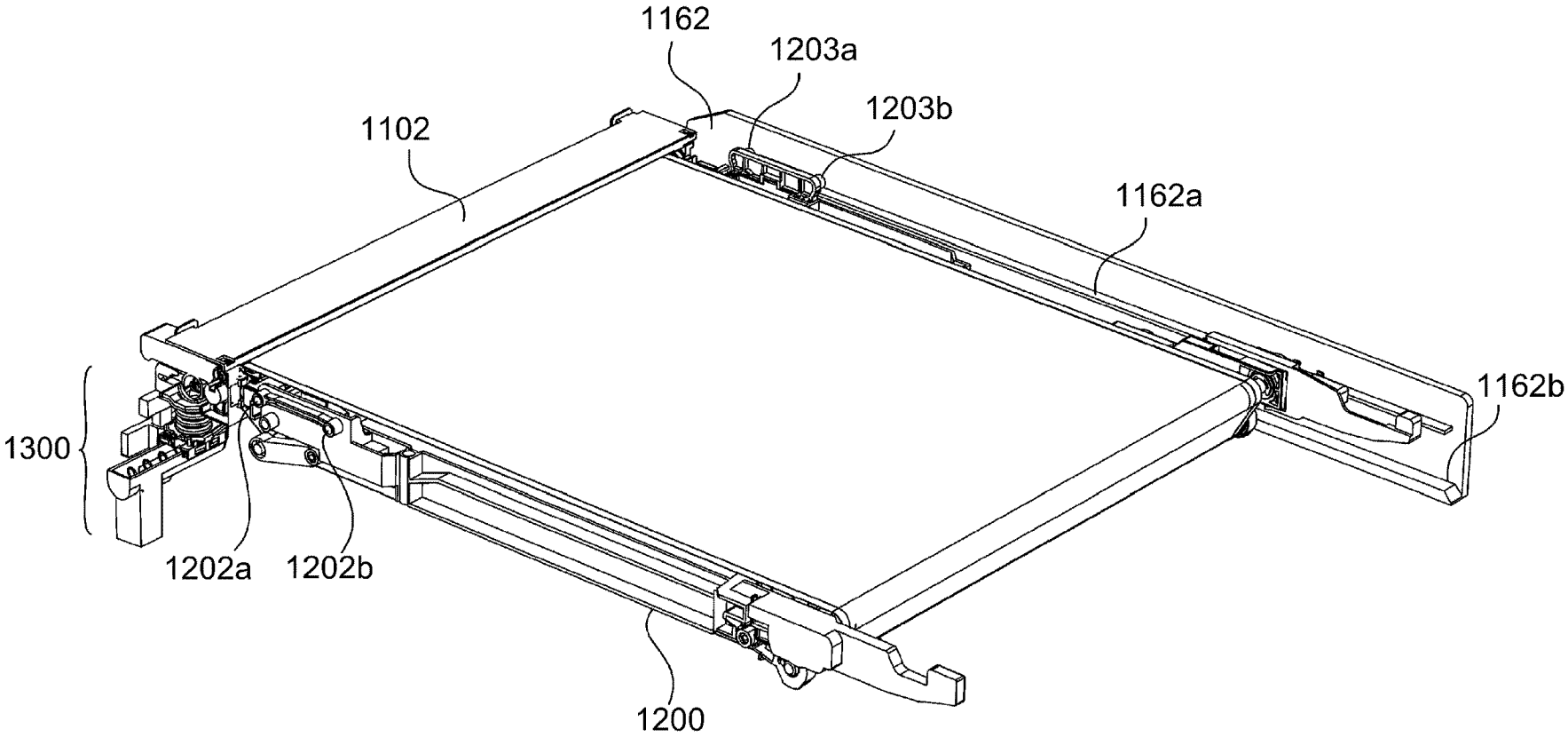

FIG. 25 is a perspective view showing a state in which the intermediary transfer unit is mounted in guiding rails.

Figure 26:
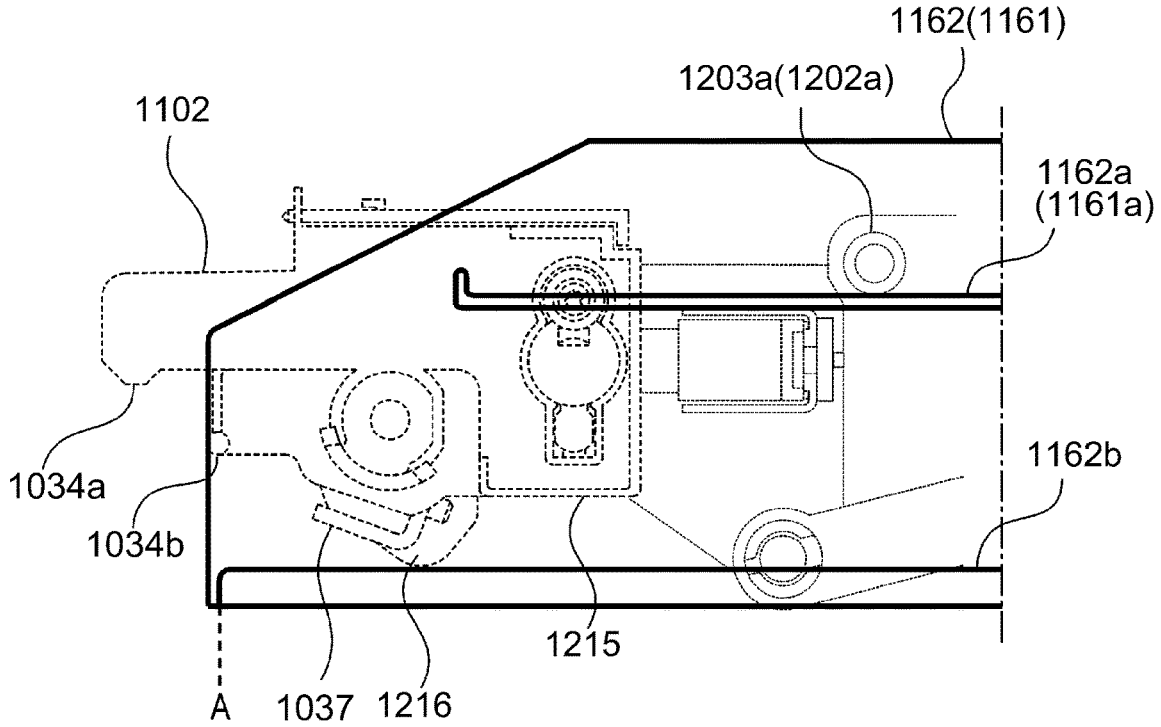

FIG. 26 is an illustration of the guiding rails.

Figure 27:
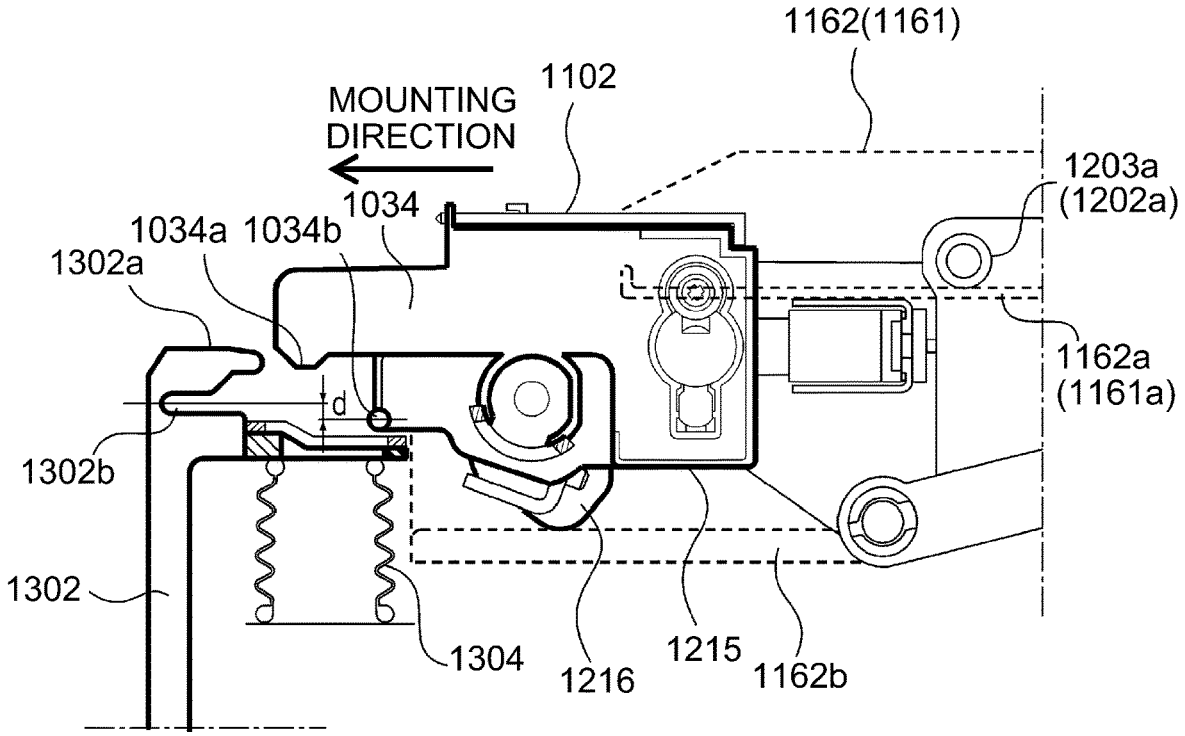

FIG. 27 is an illustration of a position in a connecting process.

Figure 28:
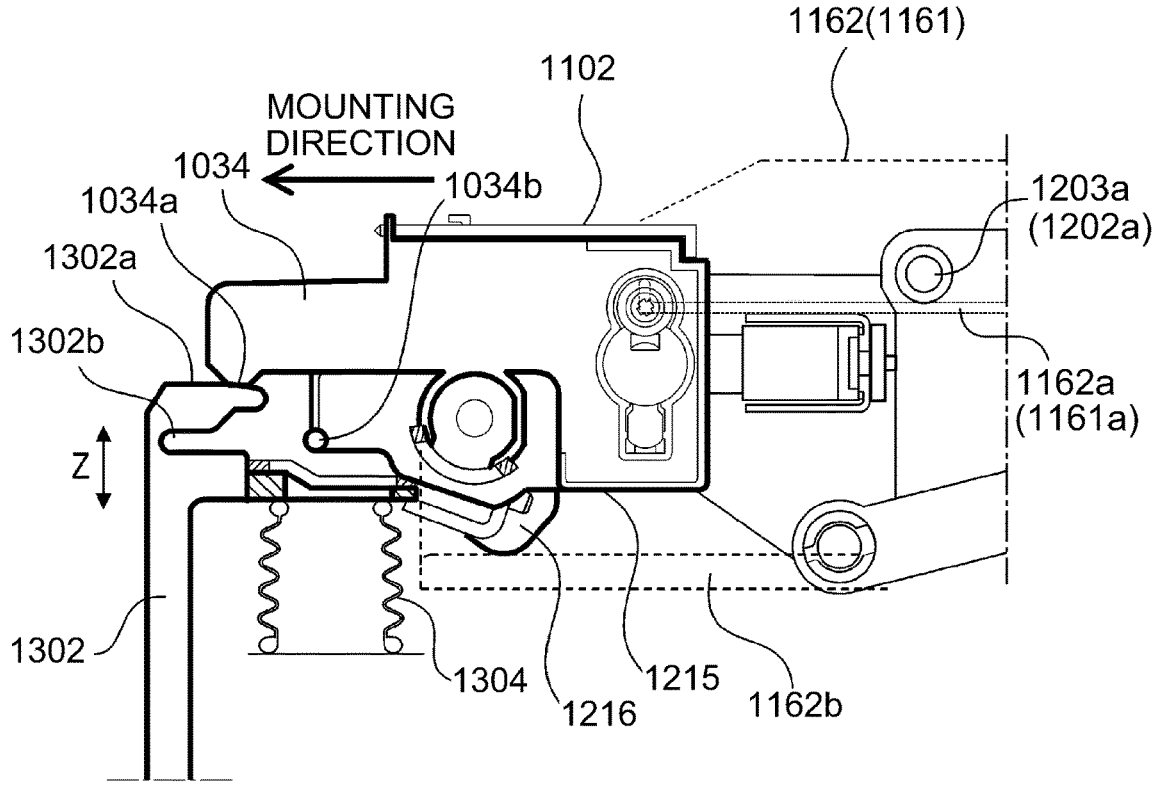

FIG. 28 is an illustration of another position in the connecting process.

Figure 29:
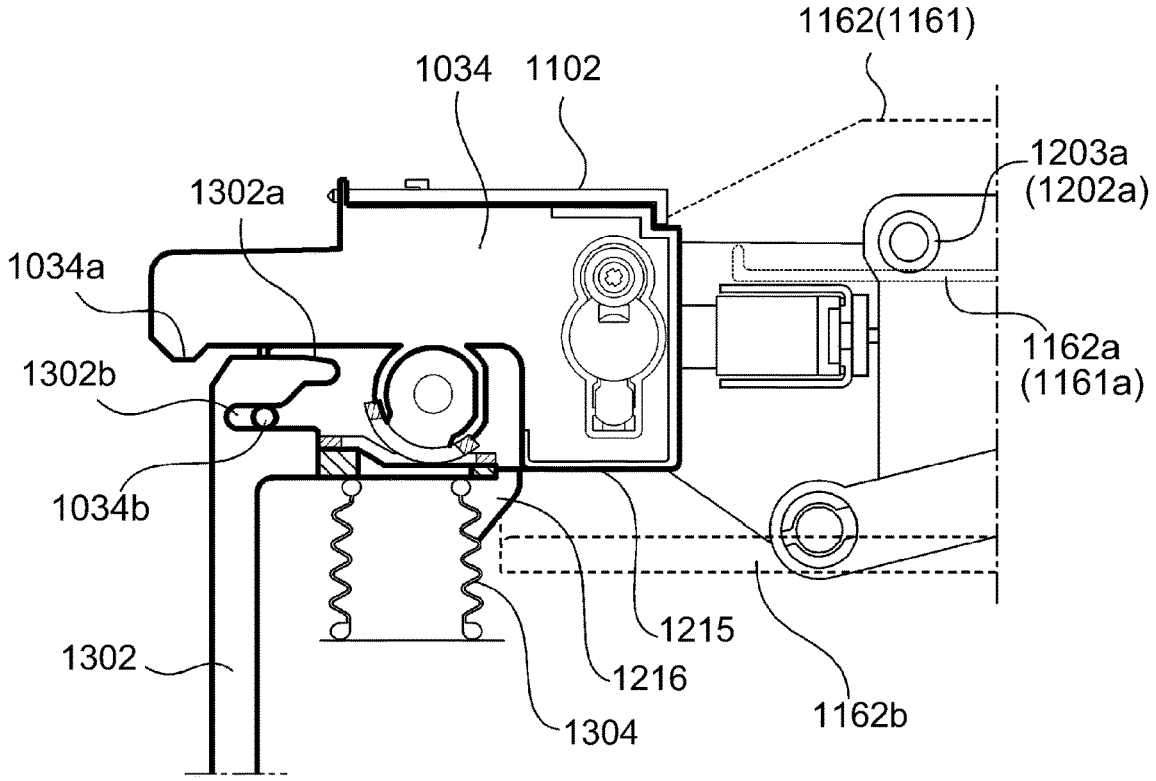

FIG. 29 is an illustration of a position of completion of mounting.

Figure 30:
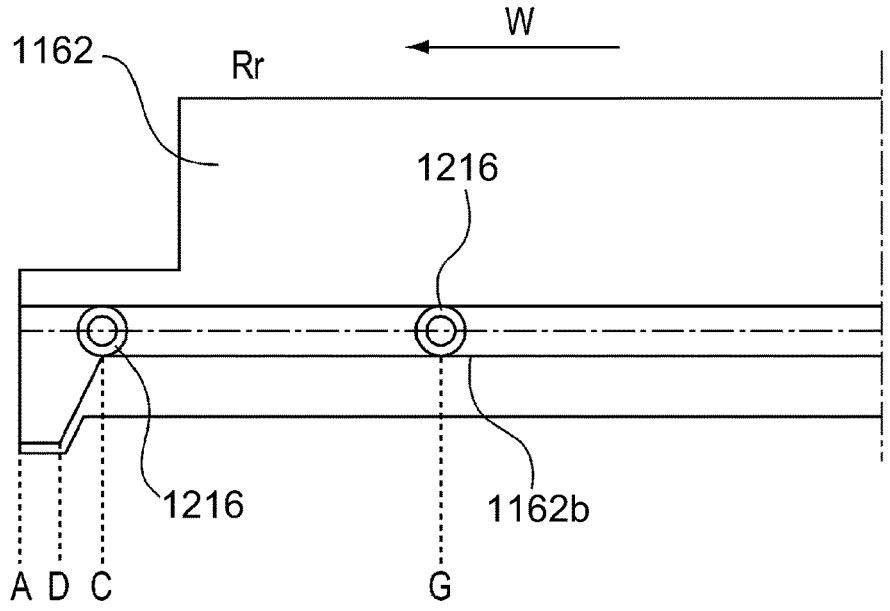
Figure 30:
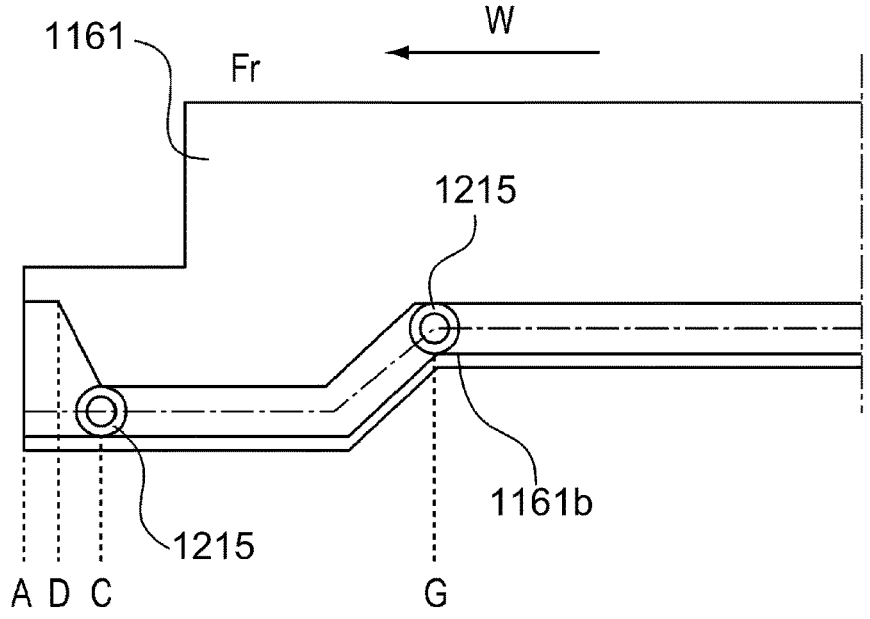

Parts (a) and (b) of FIG. 30 are illustrations of the guiding rails on a rear side and a front side, respectively, of an apparatus main assembly of the image forming apparatus.

DESCRIPTION OF THE EMBODIMENTS

An image forming apparatus according to the present invention will be described with reference to the drawings.

Embodiment 1

1. General Structure and Operation of Image Forming Apparatus

Figure 1:
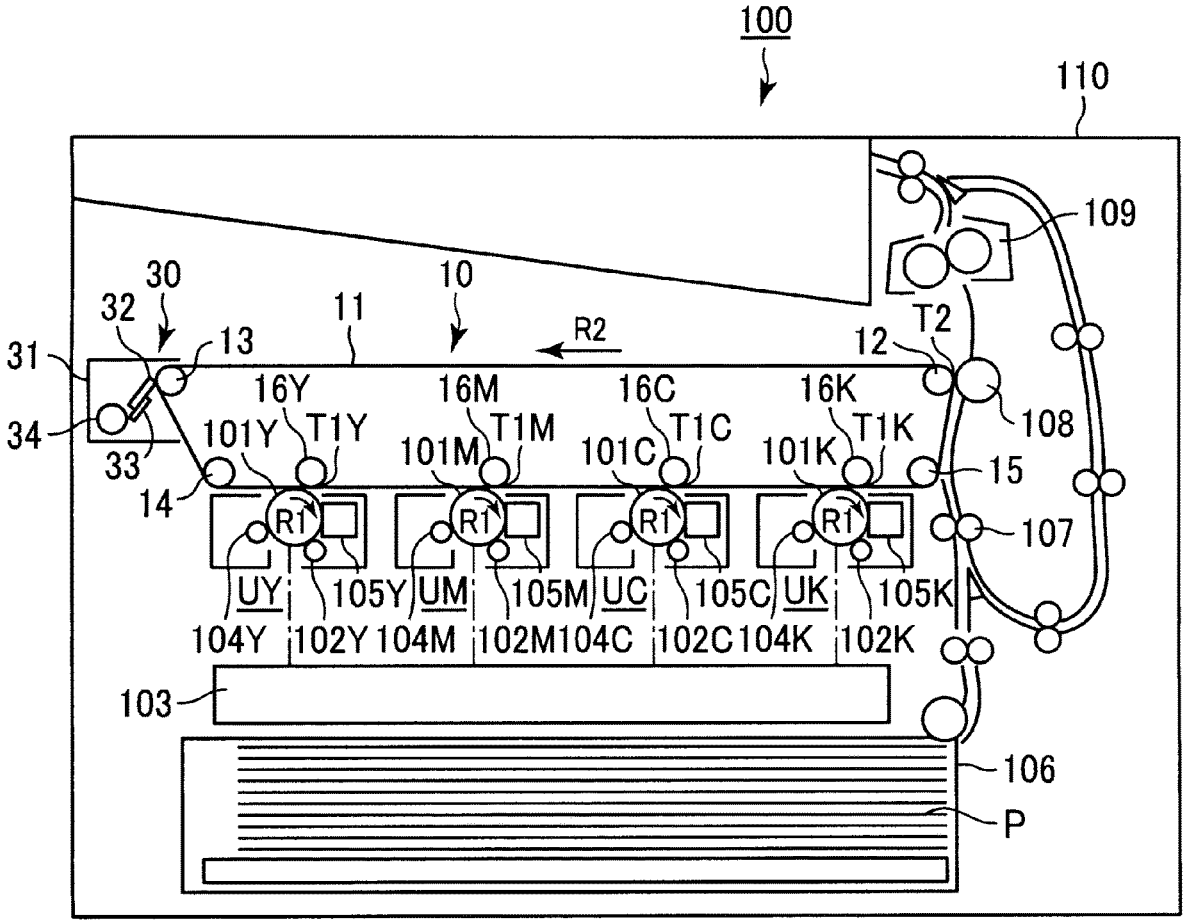
FIG. 1 is a schematic sectional view of an image forming apparatus.

FIG. 1 is a schematic sectional view of an image forming apparatus 100 in this embodiment.

The image forming apparatus 100 in this embodiment is a tandem-type multi-function machine which is capable of forming a full-color image using an electrophotographic method and which employs an intermediary transfer method, and which has functions of a copying machine, a printer and a facsimile machine. The image forming apparatus 100 is capable of forming and outputting an image on a sheet-like recording material P in accordance with an image signal sent from an image reading device (not shown), a personal computer or the like.

The image forming apparatus 100 includes, as a plurality of image forming portions (image forming units), first to fourth image forming portions UY, UM, UPC and UK for forming images of color of yellow (Y), magenta (M), cyan (C) and black (K), respectively. As regards elements having the same or corresponding functions or constitutions in the respective image forming portions UY, UM, UC and UK, suffixes Y, M, C and K for representing the elements for associated colors, respectively, are omitted, and the elements will be collectively described in some cases. Each image forming portion U is constituted by including a photosensitive drum 101, a charging roller 102, an exposure device 103, a developing device 104, a primary transfer roller 16 and a drum cleaning device 105, which are described below.

The image forming portion U includes, as an image bearing member, the photosensitive drum 101 which is a rotatable drum-shaped (cylindrical) photosensitive member (electrophotographic photosensitive member). The photosensitive drum 101 is rotationally driven at a predetermined peripheral speed in an arrow R1 direction (clockwise direction) in FIG. 1. A surface of the rotating photosensitive drum 101 is electrically charged uniformly to a predetermined polarity (negative in this embodiment) and a predetermined potential by the charging roller 102 which is a roller-shaped charging member as a charging means. The charged surface of the photosensitive drum 101 is subjected to scanning exposure by the exposure device (laser scanner) 103 as an exposure means, so that an electrostatic image (electrostatic latent image) is formed on the surface of the photosensitive drum 101. In this embodiment, the exposure device 103 is constituted as a single unit for exposing the respective photosensitive drums 101 to light. The exposure device 103 projects (emits) laser light on the respective photosensitive drums 101 on the basis of pieces of image information (image signals) of the respective colors. The electrostatic image formed on the photosensitive drum 101 is developed (visualized) by being supplied with toner by the developing device 104 as a developing means, so that a toner image (developer image) is formed on the photosensitive drum 101. In this embodiment, on an exposed portion (image portion) of the photosensitive drum 101 where an absolute value of the potential is lowered by the exposure to light after the uniform charging of the photosensitive drum surface, the toner charged to the same polarity as the charge polarity (negative in this embodiment) of the photosensitive drum 101 is deposited.

An intermediary transfer belt 11, which is a rotatable intermediary transfer member constituted by an endless belt, is provided so as to oppose the four photosensitive drums 101. The intermediary transfer belt 1 is extended around and stretched by, as a plurality of stretching rollers, a secondary transfer opposite roller 12, a steering roller 13, and idler rollers 14 and 15. In this embodiment, the secondary transfer opposite roller 12 also functions as a driving roller. That is, the secondary transfer opposite roller 12 not only rotates (circulates and moves) the intermediary transfer belt 11 by being driven by a driving source (not shown), but also functions as an opposing member (opposite electrode) to a secondary transfer roller 108 (described later). The intermediary transfer belt 11 is rotated at a predetermined peripheral speed (surface movement speed) in an arrow R2 direction (counterclockwise direction) in FIG. 1 by transmission of a driving force thereto by the secondary transfer opposite roller 12. The peripheral speed of the intermediary transfer belt 11 is set at the substantially same peripheral speed (process speed) of the photosensitive drums 101. In this embodiment, the steering roller 13 also functions as a tension roller. That is, the steering roller 13 not only constitutes a steering unit 1 described specifically later and adjusts a feeding position of the intermediary transfer belt 11, but also imparts a predetermined tension to the intermediary transfer belt 11. The first and second idler rollers 14 and 15 support the intermediary transfer belt 11 extending along an arrangement direction of the photosensitive drums 101. Incidentally, the number of the plurality of steering rollers steering the intermediary transfer belt 11 is not limited to four, but may also be less than or more than four.

In an inner peripheral surface side of the intermediary transfer belt 11, primary transfer rollers 16 which are roller-shaped primary transfer members as primary transfer means are provided correspondingly to the photosensitive drums 101. Each of the primary transfer rollers 16 is urged (pressed) against the intermediary transfer belt 1 toward the associated photosensitive drum 101, so that a primary transfer portion (primary transfer nip) T1 where the photosensitive drum 101 and the intermediary transfer belt 11 are in contact with each other is formed. The toner images formed on the photosensitive drums 101 as described above are primary-transferred onto the rotating intermediary transfer belt 1 at the primary transfer portions T1 by a predetermined pressure and an electrostatic load bias which are imparted by the primary transfer rollers 16. During the primary transfer step, to the primary transfer rollers 16, a primary transfer voltage (primary transfer bias) of an opposite polarity (positive in this embodiment) to the normal charge polarity (the charge polarity during development) of the toner is applied by a primary transfer voltage source (high voltage source circuit). For example, during full-color image formation, the toner images of the respective colors of Y, M, C and K formed on the respective photosensitive drums 101 are successively primary-transferred superposedly onto the intermediary transfer belt 11 at the primary transfer portions T1.

In an outer peripheral surface side of the intermediary transfer belt 11, at a position opposing the secondary transfer opposite roller 12, the secondary transfer roller 108 which is a roller-shaped secondary transfer member as a secondary transfer means is provided. The secondary transfer roller 108 is urged (pressed) against the intermediary transfer belt 11 toward the secondary transfer opposite roller 12, and forms a secondary transfer portion (secondary transfer nip) T2 where the intermediary transfer belt 11 and the secondary transfer roller 108 are in contact with each other.

The toner images formed on the intermediary transfer belt 11 as described above are secondary-transferred at the secondary transfer portion T2 onto a recording material (recording medium, sheet) P by a predetermined pressure and an electrostatic load bias which are imparted by the secondary transfer roller 108. At the secondary transfer portion T2, the recording material P is nipped and fed by the intermediary transfer belt 1 and the secondary transfer roller 108. During a secondary transfer step, to the secondary transfer roller 108, a secondary transfer voltage (secondary transfer bias) of an opposite polarity (positive in this embodiment) to the normal charge polarity of the toner is applied by a secondary transfer voltage source (high-voltage source circuit). The recording material P is fed one by one from a recording material accommodating portion 106 by a pick-up roller or the like and is conveyed to a registration roller pair 107. This recording material P is conveyed toward the secondary transfer portion T2 by the registration roller pair 107 while being timed to the toner images on the intermediary transfer belt 11.

The recording material P on which the toner images are transferred is conveyed to a fixing device 109 as a fixing means. The fixing device 109 fixes (melts) the toner images on the recording material P by heating and pressing the recording material P carrying thereon unfixed toner images. The recording material S on which the toner images are transferred is discharged (outputted) toward an outside of an apparatus main assembly 110 of the image forming apparatus 100.

Further, toner (primary transfer residual toner) remaining on the surface of each of the photosensitive drums 101 without being transferred onto the intermediary transfer belt 11 during the primary transfer is removed and collected from the photosensitive drum 101 by the drum cleaning device 105 as a photosensitive member cleaning means. Further, on the outer peripheral surface side of the intermediary transfer belt 11, at a position opposing the steering roller 13, a belt cleaning device 30 as an intermediary transfer member cleaning means is provided. Toner (secondary transfer residual toner) remaining on the intermediary transfer belt 11 without being transferred onto the recording material P during the secondary transfer is removed and collected from the intermediary transfer belt 11 by the belt cleaning device 30. The belt cleaning device 30 will be further described later specifically.

Incidentally, in this embodiment, the image forming apparatus 100 includes the four image forming portions U for the four colors, but the number of the image forming portions U is not limited to four, and an order of arrangement of the image forming portions for forming the images of the respective colors is also not limited to the arrangement order in this embodiment.

2. Belt Unit

In this embodiment, the intermediary transfer belt 11, the stretching rollers 12 to 15 thereof, the respective primary transfer rollers 16, the belt cleaning device 30 and the like constitutes a belt unit (intermediary transfer belt unit) 10 as a belt feeding device. In this embodiment, the belt unit 10 is mountable to and dismountable from the apparatus main assembly 110.

The belt unit 10 includes a unit frame (casing) 2 (FIG. 2) as a first supporting member and a supporting table 8 (FIG. 2) as a second supporting member. The unit frame 2 rotatably supports the secondary transfer roller 12 and the first and second idler rollers 14 and 15 of the plurality of stretching rollers, and the respective primary transfer rollers 16. The supporting table 8 rotatably supports the steering roller 13 of the plurality of stretching rollers. The supporting table 8 is swingably (rotatably or pivotably) supported by the unit frame 2. As a result, alignment of the steering roller 13 relative to the secondary transfer opposite roller 12 can be changed. That is, the supporting table 8 rotatably supports the steering roller 13 and is swingable so as to change an angle of a rotational axis of the steering roller 13 relative to a rotational axis of the secondary transfer opposite roller 12. As described later, the steering roller 13, the supporting table 8 and the like constitute a steering unit 1 as a steering mechanism for controlling a feeding position of the intermediary transfer belt 11 with respect to a widthwise direction (rotational axis direction of the steering roller 13) substantially perpendicular to a circumferential direction (surface movement direction) of the intermediary transfer belt 11.

3. Steering Unit

Figure 2:
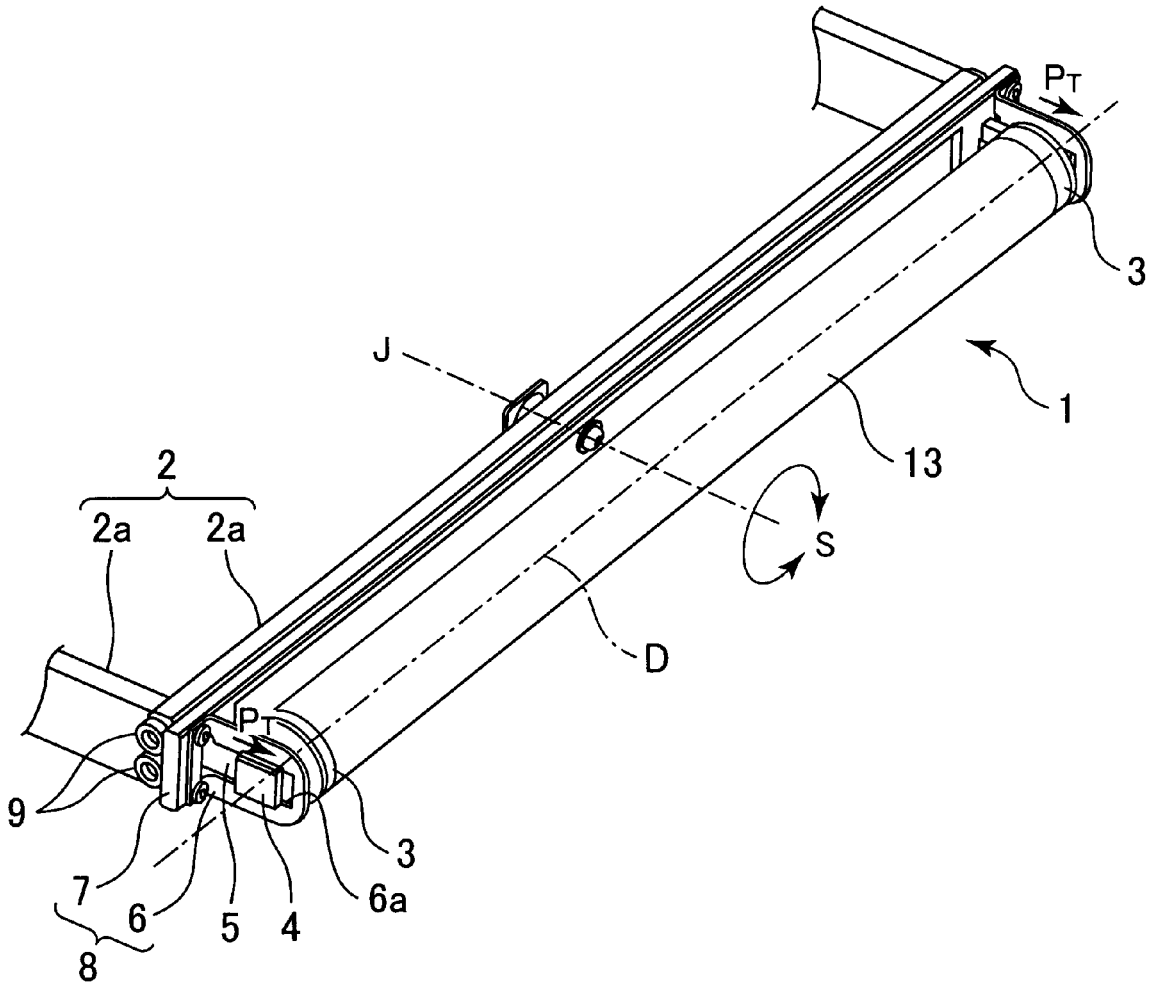
FIG. 2 is a perspective view of a steering unit and a neighborhood of the steering unit.

Next, the steering unit 1 as a steering mechanism (automatic belt center alignment mechanism) in this embodiment will be described. FIG. 2 is a perspective view of the steering unit 1 as the steering mechanism in this embodiment and the neighborhood of the steering unit 1.

The steering roller 13 as a steering member is rotatably supported by the supporting table 8. The supporting table 8 is constituted by including a swingable plate 7 and a side supporting member 6. The swingable plate 7 is supported by the unit frame 2 so as to be swingable about a steering axis (swing axis) J substantially at a central portion thereof with respect to a rotational axis D direction of the steering roller 13. The rotational axis D of the steering roller 13 and the steering axis J are substantially perpendicular to each other. The side supporting member 6 is fixed to each of opposing end portions of the swingable plate 7 with respect to a longitudinal direction (rotational axis D direction of the steering roller 13) of the swingable plate 7. Each of the side supporting members 6 is provided with a slide groove 6*a*. With each of the slide grooves 6*a*, a slide bearing member 4 is slidably engaged. Each of the slide bearing members 4 is urged in an arrow $P_T$ direction (direction from an inner peripheral surface side toward an outer peripheral surface side) in FIG. 2 by a tension spring (compression spring) 5 which is an elastic member as an urging means.

The steering roller 13 is supported by a steering roller shaft 13*a* (part (a) of FIG. 4) in a rotatable state about the steering roller shaft 13*a* by bearings or the like incorporated therein. Opposite end portions of the steering roller shaft 13*a* with respect to the axial direction have a D-cut shape, and are supported by the slide bearing members 4 in a non-rotatable state about the slide bearing members 4. As a result, the steering roller 13 is rotated by the intermediary transfer belt 11 while imparting tension to the intermediary transfer belt 11 in a state in which the steering roller 13 is swingably supported by the supporting table 8.

Further, at the end portions of the steering roller 13 with respect to the rotational axis D direction, sliding rings 3 which have a larger frictional resistance against the intermediary transfer belt 11 than the steering roller 13 and which are used as slidable members are provided. Each of the sliding rings 3 is supported with a parallel pin or the like by the steering roller shaft 13*a* in a non-rotatable state about the steering roller shaft 13*a* (part (a) of FIG. 4) so as not to be rotated by the intermediary transfer belt 11. Accordingly, when the intermediary transfer belt 11 is rotated, the steering roller 13 does not slide on the inner peripheral surface of the intermediary transfer belt 11, but the sliding rings 3 slide on the inner peripheral surface of the intermediary transfer belt 11.

Thus, the supporting table 8 supports the steering roller 13 and the sliding rings 3 so as to be swingable about the steering axis J extending in a direction crossing (in this embodiment, substantially perpendicular to) the rotational axis D of the steering roller 13. Further, the steering roller 13 which is a rotatable member provided at a central portion with respect to the rotational axis D direction of the steering roller 13 and the sliding rings 3 which are slidable portions provided at the end portions of the steering roller 13 with respect to the rotational axis D direction are connected coaxially with each other.

A frame stay 2*a* which is a member constituting the unit frame 3 is extended and provided between side plates 2*b* on opposite sides of the unit frame 2. At each of opposite end portions of the frame stay 2*a* with respect to a longitudinal direction (rotational axis D direction of the secondary transfer opposite roller 12), two slidable rollers 9 are provided. The slidable rollers 9 are rotatably supported by the frame stay 2*a*. The swingable plate 7 is disposed so as to opposite the frame stay 2*a*. The swingable plate 7 is supported by the frame stay 2*a* so as to be swingable about the steering axis J in an arrow S direction in FIG. 2. The slidable rollers 9 have a function of reducing a resistance (rotational resistance) against the frame stay 2*a* when the swingable plate 7 is swung.

Figure 3:
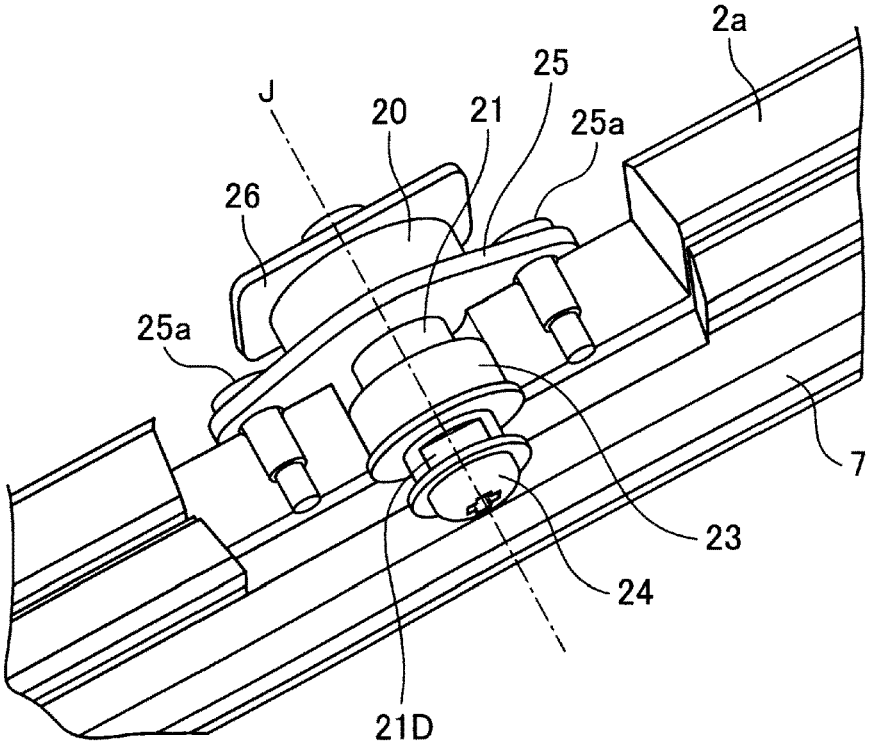
FIG. 3 is a partially cut-away perspective view showing neighborhood of a swing center of the steering unit.

FIG. 3 is a partially cut-away perspective view showing a structure of a swing center portion of the supporting table 8. At a central portion (center portion) of the swingable plate 7 with respect to the longitudinal direction, a steering shaft 21 which is a swing shaft (rotation shaft) is fixed. The steering shaft 21 is provided with a key-shaped portion 21D cut at two portions on one end side with respect to an axial direction thereof (i.e., cut along two planes of a part of a cylindrical outer peripheral surface of the steering shaft 21), and is integrally fastened to the swingable plate 7 with a screw 24 in an engaged state with the swingable plate 7. This steering shaft 21 is inserted in a bearing (shaft-supporting portion) 23 such as a bearing provided on the frame stay 2*a* and is rotatably supported by the frame stay 2*a* via the bearing 23. At the other end portion of the steering shaft 21 with respect to the axial direction, a thrust retaining member 26 is fixed via a fixing member 20, so that retention of the steering shaft 21 is realized. Further, a supporting plate 25 is interposed between the frame stay 2*a* and the fixing member 20 in a state in which the steering shaft 21 is penetrated through the supporting plate 25, and is fixed to the frame stay 2*a* with screws 25*a*. An axis of the steering shaft 21 constitutes the steering axis J.

In this embodiment, the steering unit 1 as a steering mechanism is constituted by the supporting plate 8, the steering roller 13, the sliding rings 3, the steering roller shaft 13*a*, the steering shaft 21 and the like which are described above.

4. Automatic Belt Center Alignment

Next, automatic belt center alignment by the steering unit 1 will be described. Parts (a) and (b) of FIG. 4 are perspective views showing examples of the sliding rings 3. Parts (a) and (b) of FIG. 5 are schematic views for illustrating a relationship in bearing width between the intermediary transfer belt 11 and the sliding rings 3.

In part (a) of FIG. 4, as an example of the sliding rings 3, a sliding ring 3*a* of a straight type in which an outer diameter of the steering roller is substantially the same with respect to the axial direction (rotational axis direction of the steering roller 13) is shown. In part (b) of FIG. 4, as another example of the sliding rings 3, a sliding ring 3*b* of a taper type in which the outer diameter of the steering roller 13 continuously increases toward an outside (a side opposite from the steering axis J side) with respect to the axial direction (rotational axis direction of the steering roller 13) is shown.

As described above, the steering roller 13 is supported by the steering roller shaft 13*a* in the rotatable state about the non-rotatable steering roller shaft 13*a*. On the other hand, the sliding rings 3 (3*a*, 3*b*) provided at the opposite end portions of the steering roller 13 with respect to the rotational axis direction of the steering roller 13 are supported by the steering roller shaft 13*a* in the non-rotatable state about the non-rotatable steering roller shaft 13*a*. Accordingly, when the intermediary transfer belt 11 is rotated, the steering roller 13 does not slide on the inner peripheral surface of the intermediary transfer belt 11, but the sliding rings 3 (3*a*, 3*b*) slides on the inner peripheral surface of the intermediary transfer belt 11. By such a constitution, automatic belt center alignment is enabled. That is, when a receiving where the sliding rings 3 (3*a*, 3*b*) and the intermediary transfer belt 11 are in contact with each other in a predetermined amount or more, the steering unit 1 starts steering.

Incidentally, a constitution in which the sliding rings 3 (3*a*, 3*b*) are rotatably supported may also be employed. However, in that case, there is a need that a torque required for rotating the sliding rings 3 in the rotational direction of the intermediary transfer belt 11 is large them a torque required for rotating the steering roller 13 in the same direction. As a result, the steering is enabled.

In this embodiment, a width (a length with respect to a direction substantially perpendicular to a surface movement direction) of the intermediary transfer belt 11 is broader than a width (a length with respect to the rotational axis direction) of the steering roller 13 and is narrower than a total width including the width of the steering roller 13 are widths of the sliding rings 3 at the opposite end portions of the steering roller 13. For that reason, in this embodiment, when the intermediary transfer belt 11 is in an ideal steady center alignment state, the relationship in bearing width between the intermediary transfer belt 11 and the sliding rings 3 is as shown in part (a) of FIG. 5. That is, bearing widths w (hatched portions in the figure) are substantially equal to each other at the opposite end portions of the intermediary transfer belt 11 with respect to a widthwise direction of the intermediary transfer belt 11. In the case of such a bearing width relationship, even when a belt shift occurs during rotation of the intermediary transfer belt 11, the intermediary transfer belt 11 always slides with at least one of the sliding rings 3. On the other hand, in the case where the width of the intermediary transfer belt 11 is narrower than the width of the steering roller 13, the bearing width relationship between the intermediary transfer belt 11 and the sliding rings 3 is as shown in part (b) of FIG. 5. In this case, even when the belt shift occurs during the rotation of the intermediary transfer belt 11, the steering unit 1 is not swung until the bearing width between the intermediary transfer belt 1 and the sliding ring 3 generates. For that reason, an abrupt center alignment opening is liable to occur. In principle, even in the bearing width relationship as shown in part (b) of FIG. 5, the automatic belt center alignment using a balance of the frictional force can be carried out. However, the bearing width relationship as shown in part (a) of FIG. 5 in which the balance of the frictional force can always be detected enables finer center alignment opening, and therefore, has an advantage such that a large fluctuation in timewise change of a rubber angle does not occur.

Thus, in this embodiment, slidable members 3 for generating a force for swinging the supporting plate 8 by sliding with the intermediary transfer belt 11 through rotation of the intermediary transfer belt 11 are provided at the opposite end portions of the steering roller 13 with respect to the rotational axis direction of the steering roller 13. Further, the position of the intermediary transfer belt 11 is automatically adjusted by the rotation of the intermediary transfer belt 11.

5. Belt Cleaning Device

The belt cleaning device 30 in this embodiment will be described. Incidentally, as regards the image forming apparatus 100 and elements thereof, a front side of the drawing sheet of FIG. 1 is a front (surface) side, and a rear side of the drawing sheet of FIG. 1 is a rear (surface) side. A direction perpendicular to the drawing sheet of FIG. 1 connecting the front side and the rear side is substantially parallel to the rotational axis direction of the photosensitive drum 1 or the widthwise direction of the intermediary transfer belt 11. Further, as regards the image forming apparatus 100 and the elements thereof, a vertical (up-down) direction refers to a vertical direction with respect to a direction of gravitation.

As shown in FIG. 1, the cleaning device 30 includes a cleaning container 31, a cleaning blade 32 as a cleaning member, a fixing metal plate 33 as a blade fixing member, and a feeding screw 34 as a feeding member. The cleaning blade 32 is bonded and fixed to the fixing metal plate 33 and this fixing metal plate 33 is fixed to the cleaning container 31. The feeding screw 34 is rotatably supported by the cleaning container 31.

The cleaning blade 32 is disposed at a position opposing the steering roller 13 through the intermediary transfer belt 11 and contacts the intermediary transfer belt 11 toward the steering roller 13. That is, the cleaning blade 32 applies an external force to the steering roller 13 through the intermediary transfer belt 11. In this embodiment, the cleaning blade 32 is formed of a urethane rubber as an elastic material. The cleaning blade 32 is a plate-like member which has lengths with respect to a longitudinal direction disposed substantially in parallel to the widthwise direction (the rotational axis direction of the steering roller 13) of the intermediary transfer belt 11 and with respect to a widthwise (short side) direction substantially perpendicular to the longitudinal direction and which has a predetermined thickness. The cleaning blade 32 is contacted to the intermediary transfer belt 11 with an angle at which the cleaning blade 32 extends in a counterdirection to the rotational direction of the intermediary transfer belt 11. Further, in this embodiment, the width of the cleaning blade 32 with respect to the longitudinal direction is shorter than the width (the length with respect to the rotational axis direction) of the steering roller 13.

The toner on the intermediary transfer belt 11 is scraped off of the rotating intermediary transfer belt 11 by the cleaning blade 32 and is accommodated inside the cleaning container 31. The toner accommodated inside the cleaning container 31 is fed by the feeding screw 34 toward the front side along the longitudinal direction (rotational axis direction of the steering roller 13) of the cleaning device 30. Further, as specifically described later, the toner fed by the feeding screw 34 is sent toward and collected in a collecting container 51 provided inside the apparatus main assembly 110 on the front side of the apparatus main assembly 110.

FIG. 6 is a perspective view of the belt unit 10 in this embodiment and a neighborhood of the belt unit 10. FIG. 7 is an exploded perspective view of the cleaning device 30 and a periphery thereof. FIG. 8 is a schematic sectional view of a communicating member 40 (described later) and a neighborhood of the communicating member 40. The cleaning device 30 is held by the belt unit 10. In this embodiment, the cleaning device 30 is held (positioned) by the supporting table 8 of the steering unit 1 via a holding mechanism such as a holding portion 31*a* provided on the cleaning container 31. As a result, the cleaning device 30 is swingable integrally with the steering unit 1 (steering roller 13). The cleaning blade 32 is capable of collecting the toner from the intermediary transfer belt 11 in a state in which a contact state with the intermediary transfer belt 11 is maintained even in the case where the steering unit 1 is inclined in any direction about the steering axis J. Further, in this embodiment, in a state in which the belt unit 10 is mounted in the apparatus main assembly 110, the cleaning device 30 is supported by a cleaning device supporting member 61 provided in the apparatus main assembly 110. The cleaning device supporting member 61 supports a lower portion of the cleaning container 31 from an outside of the cleaning container 31 at a substantially central portion of the cleaning container 31 with respect to the longitudinal direction (rotational axis direction of the steering roller 13) of the cleaning container 31, i.e., at a position corresponding to the steering axis J. As a result, the cleaning device supporting member 61 does not prevent the steering unit 1 from swinging.

The cleaning device 30 is provided with a discharging portion 35 provided with a discharge opening 35*a* for permitting discharge of the toner in the cleaning container 31 toward the outside of the cleaning container 31 through the discharge opening 35*a*. In this embodiment, the discharging portion 35 is provided integrally with the cleaning container 31 at a front-side end portion of the cleaning container 31 with respect to the longitudinal direction of the cleaning container 31. In this embodiment, the discharge opening 35*a* is open downward. That is, in this embodiment, the discharging portion 35 is disposed on one end portion side (on the front-side end portion side in this embodiment) of the cleaning device 30 than the steering axis J is with respect to the rotational axis direction of the steering roller 13. On the other hand, the apparatus main assembly 110 is provided with a collecting portion 50 which is configured to collect the toner discharged from the cleaning container 31 and which is disposed at a predetermined position is provided. In this embodiment, the collecting portion 50 is constituted by including a collecting container 51 and a feeding portion 52 as a receiving portion. The feeding portion 52 is provided with a receiving opening 50*a* for receiving the toner from an outside toward an inside of the collecting portion 5*a*. The feeding portion 52 is provided with a feeding member 52*a* for feeding the toner, toward the collecting container 51, received inside the collecting portion 50 through the receiving opening 50*a*. The feeding member 52 is constituted by a screw and the like. The image forming apparatus 100 includes the communicating member 40 for communicating the discharge opening 35*a* of the cleaning device 30 and the receiving opening 50*a* of the collecting portion 50 with each other. That is, in this embodiment, in the state in which the belt unit 10 is mounted in the apparatus main assembly 110, the communicating member 40 causes the discharge opening 35*a* on the belt unit 10 side and the receiving opening 50*a* on the apparatus main assembly 110 side to communicate with each other.

The communicating member 40 is constituted by including an upper engaging portion 41 as a first engaging portion, a lower engaging portion 42 as a second engaging portion, and a tube-shaped portion 43 connected with the upper engaging portion 41 and the lower engaging portion 42. The upper engaging portion 41 is provided with an upper opening 41*a* as a first opening communicating with the discharge opening 35*a* of the cleaning device 30. The upper engaging portion 41 engages with the discharging portion 35 of the cleaning device 30 and is movable with the swing of the steering unit 1. The lower engaging portion 42 is provided with a lower opening 42*a* as a second opening communicating with the receiving opening 50*a* of the collecting portion 50. The lower engaging portion 42 engages with the feeding portion 52 of the collecting portion 50 and is disposed substantially at a fixing position. The tube-shaped portion 43 is fixed integrally to the upper engaging portion 41 and the lower engaging portion 42 by a fixing means such as welding (bonding in this embodiment). As a result, the communicating member 40 is sealed so that the toner is not leaked from the inside to the outside thereof. In this embodiment, the upper engaging portion 41 is connected to the discharging portion 35 of the cleaning device 30 so as to be mountable to and dismountable from the discharging portion 35 when the belt unit 10 is mounted in the apparatus main assembly 110. Further, in this embodiment, the upper engaging portion 41 is disconnected form the discharging portion 35 of the cleaning device 30 when the belt unit 10 is dismounted form the apparatus main assembly 110. On the other hand, in this embodiment, the lower engaging portion 42 is substantially fixed to the feeding portion 52 of the collecting portion 50.

Here, the belt unit 10 is supported by an unshown supporting frame provided in the apparatus main assembly 110. In this embodiment, when the belt unit 10 is mounted in the apparatus main assembly 110, the discharging portion 35 of the cleaning device 30 communicates with the upper engaging portion 41 of the communicating member 40 held by the apparatus main assembly 110, so that the discharge opening 35*a* and the upper opening 41*a* communicate with each other. In this embodiment, the cleaning device 30 is provided with a shutter member 36 capable of opening and closing the discharge opening 35*a* of the cleaning device 30. The shutter member 36 opens the discharge opening 35*a* in interrelation with a mounting operation of the belt unit 10 into the apparatus main assembly 110 when the upper engaging portion 41 of the communicating member 40 engages with the discharging portion 35 of the cleaning device 30. Further, the shutter member 36 closes the discharge opening 35*a* in interrelation with a dismounting opening of the belt unit 10 from the apparatus main assembly 110 when the engagement between the upper engaging portion 41 and the discharging portion 35 is eliminated.

The tube-shaped portion 43 is constituted by a bellows-shaped elastic member which is capable of expansion and contraction with movement of the upper engaging portion 41 and which is provided with a feeding path 43*a* formed therein so as to guide the toner, toward the lower opening 42*a*, received through the upper opening 41*a*. The tube-shaped portion 43 is capable of expanding to until bellows stretch with respect to a vertical direction and is capable of contracting until the bellows collapse and overlap with since the tube-shaped portion 43 is constituted by the bellows-shaped elastic member. In this embodiment, the tube-shaped portion 43 is formed of a rubber material as an elastic material. However, the material of the tube-shaped portion 43 is not limited to the rubber material, but for example, an arbitrary material such as a resin material when sufficient expansion and contraction property and durability can be obtained.

The cleaning blade 32 contacts the intermediary transfer belt 11 in an elastically deformed state and scrapes off the toner of the intermediary transfer belt 11. The toner scraped off of the intermediary transfer belt 11 id dropped in the cleaning device 30. The toner dropped in the cleaning device 30 is fed to the discharge opening 35*a* provided at the front-side end portion of the cleaning device 30 with respect to the longitudinal direction of the cleaning device 30 by the feeding screw 34 disposed so as to extend along the longitudinal direction of the cleaning device 30. The toner fed to the discharge opening 35*a* passes through the inside of the tube-shaped portion 43 of the communicating member 40 through the discharge opening 35*a* by free fall, and is discharged toward an inside of the feeding portion 52 of the collecting portion 50 provided in the apparatus main assembly 110. Then, the toner discharged in the feeding portion 52 is accommodated in the collecting container 51 of the collecting portion 50 attached to the apparatus main assembly 110.

6. Operation of Communicating Member

Next, an operation of the communicating member 40 in this embodiment will be further described. FIG. 9 is a perspective view showing a state in which the steering unit 1 swings and the tube-shaped portion 43 of the communicating member 40 is expanded. FIG. 10 is a perspective view showing a state in which the steering unit 1 swings and the tube-shaped portion 43 of the communicating member 40 is contracted.

When a shift of the intermediary transfer belt 11 is generated by a fluctuation of a load on the belt unit 10 depending and distortion of the image forming apparatus 100, a use environment, a use condition such as continuous output of images with a thin density, and the like, a steering force is exerted on the steering unit 1. As a result, the steering unit 1 is swung about the steering axis J in a range of a predetermined angle θ° and corrects the shift of the belt. At this time, the cleaning device 30 is constituted so as to be swingable integrally with the steering unit 1 about the steering axis J in a range of ±1.5°. For example, in the case of the image forming apparatus 100 capable of printing an image on A3-size paper, the width of the intermediary transfer belt 11 is 297 mm or more. For that reason, in this case, end portions of the steering unit 1 and the cleaning device 30 with respect to the longitudinal direction move in the vertical direction in an amount of $\pm(297/2)\times\tan(1.5°) \approx \pm 3.9$ mm or more. Here, in consideration of variation of manufacturing and installation conditions, the case where the end portions of the steering unit 1 and the cleaning device 30 with respect to the longitudinal direction move within a range of ±5 mm was investigated. As a result thereof, it turned out that in this case, when reaction force is 50 gf or less, there is no problem about belt shift correcting power of the steering unit 1. That is, it turned out that from the viewpoint of the belt shift correcting power of the steering unit 1, a spring constant, with respect to an expansion and contraction direction of the tube-shaped portion 43 constituted by the bellow-shaped elastic member may desirably be 0.098 N/mm or less. This spring constant may preferably be as small as possible. In this embodiment, the spring constant is 0.098 N/mm or less.

For example, in the case where the intermediary transfer belt 11 shifts toward a rear side as shown in FIG. 9, the steering unit 1 swings so that a front side thereof moves upward about the steering axis J in the vertical direction in order to correct this belt shift. At that time, the tube-shaped portion 43, of the communicating member 40, constituted by the bellows-shaped elastic member expands without substantially exerting a load on the steering operation and is capable of maintaining the communication between the discharge opening 35*a* and the receiving opening 50*a*.

Further, in the case where the intermediary transfer belt 11 shifts toward a front side as shown in FIG. 10, the steering unit 1 swings so that a rear side thereof moves upward about the steering axis J in the vertical direction in order to correct this belt shift. At that time, the tube-shaped portion 43, of the communicating member 40, constituted by the bellows-shaped elastic member contracts without substantially exerting the load on the steering operation and is capable of maintaining the communication between the discharge opening 35*a* and the receiving opening 50*a*.

Here, the case where a path portion which constitutes a delivering portion of the toner from the cleaning device 30 toward the collecting portion 50 provided in the apparatus main assembly 110 and which corresponds to the tube-shaped portion 43 of the communicating member 40 in this embodiment is constituted by a rigid member will be considered. Further, similarly as in the above-described example, it is assumed that the end portions of the steering unit 1 with respect to the longitudinal direction (the rotational axis direction of the steering roller 13) move in the vertical direction in the amount (distance) of ±3.9 mm or more. In this case, in order to maintain the communication between the path portion and the collecting portion 50 in the case where the longitudinal end portions of the steering unit 1 move upward in the vertical direction, there is a need that the path portion has a length of about 5 mm or more in consideration of the variations of the manufacturing and installation conditions. Further, in order to accommodate the path portion in the case where the longitudinal end portions of the steering unit 1 swing downward in the vertical direction, a space (an accommodating region of the path portion) of 5 mm or more is needed in the collecting portion 50. For that reason, there is a possibility that a structure of the delivering portion from the cleaning device 30 toward the collecting portion 50 provided in the apparatus main assembly 110 is upsized and thus leads to upsizing of the image forming apparatus 100. Further, in the case of such a structure, in order to suppress the load on the steering operation, there is a need that a gap is formed between the path portion and the collecting portion 50 and a sealing member for sealing the gap is separately provided.

On the other hand, according to this embodiment, the tube-shaped portion 43 of the communicating member 40 is constituted by the bellows-shaped elastic member capable of expansion and contraction, so that there is no need to provide the accommodating region for the communicating member 40 in the collecting portion 50 provided in the apparatus main assembly 110. For that reason, downsizing of the structure of the toner delivering portion from the cleaning device 30 toward the collecting portion 50 provided in the apparatus main assembly 110 can be realized, so that downsizing of the image forming apparatus 100 can be realized. That is, according to this embodiment, the tube-shaped portion 43 of the communicating member 40 is constituted by the bellow-shaped elastic member, and therefore, the length of the communicating member 40 and the space occupied by the collecting portion 50 can be minimized, so that the downsizing of the image forming apparatus 100 can be realized. Further, the tube-shaped portion 43 of the communicating member 40 is capable of expansion and contraction, and therefore, the upper engaging portion 41, the lower engaging portion 42 and the tube-shaped portion 43 can be sealed by bonding or the like. For that reason, there is no need that a sealing member is separately provided for suppressing leakage of the toner from the delivering portion of the toner from the cleaning device 30 toward the collecting portion 50 provided in the apparatus main assembly 110, or necessity thereof can be reduced.

As described above, according to this embodiment, downsizing of the structure of the toner delivering portion from the cleaning device 30 swingable together with the steering roller 13 toward the collecting portion 50 disposed at the predetermined position can be realized. By this, downsizing of the image forming apparatus 100 can be realized.

Embodiment 2

Another embodiment of the present invention will be described. Basic constitutions and operations of an image forming apparatus in this embodiment are the same as those of the image forming apparatus in Embodiment 1. Accordingly, in the image forming apparatus of this embodiment, elements having the same or corresponding functions and constitutions as those of the image forming apparatus in Embodiment 1 are represented by the same reference numerals or symbols as those in Embodiment 1, and will be omitted from detailed description.

In Embodiment 1, the image forming apparatus 100 employed the automatic belt center alignment type. However, the present invention is not limited to application to the image forming apparatus employing the automatic belt center alignment type, but is applicable when the image forming apparatus is an image forming apparatus in which a cleaning device is swingable together with a steering roller. In this embodiment, the image forming apparatus 100 detects an end portion position of the intermediary transfer belt 11 with respect to a widthwise direction by a sensor and corrects the belt shift by controlling an attitude of the steering roller 13 by a drive control device on the basis of a detection result of the end portion position of the intermediary transfer belt 11. Further, in this embodiment, in the image forming apparatus 100 having such a constitution, a communicating member 40 similar to that in Embodiment 1 is applied to the toner delivering portion which is swingable together with the steering roller 13 and which delivers the toner from the cleaning device 30 toward the collecting portion 50 provided in the apparatus main assembly 110.

FIG. 11 is a perspective view of the belt unit 10 in this embodiment and a neighborhood of the belt unit 10. Parts (a) and (b) of FIG. 12 are schematic structural views for illustrating a sensor unit and a steering driving portion which are described later. FIG. 13 is a sectional side view of the communicating member 40 and a neighborhood of the communicating member 40. FIG. 14 is a perspective view of the belt cleaning device 30 and a periphery thereof.

The belt unit 10 includes a unit frame 71 as a first supporting member and a swingable frame 72 as a second supporting member. The secondary transfer opposite roller 12 and the first and second idler rollers 14 and 15 of the stretching rollers, and the respective primary transfer rollers 16 are rotatably supported by the unit frame 71. Further, the front-side end portion of the rotation shaft of the steering roller 13 of the stretching rollers is rotatably supported by the swingable frame 72. Further, the rear-side end portion of the rotation shaft of the steering roller 13 is rotatably supported by a steering arm 81 (part (a) of FIG. 12). Further, a rear-side end portion of the swingable frame 72 is rotatably held by the rear-side end portion of the rotation shaft of the steering roller 13 and is supported by the steering arm 81 (part (b) of FIG. 12) through the steering roller 13.

Further, a steering shaft 73 (FIG. 13) which is a swing shaft (rotation shaft) provided at a front-side end portion of the swingable frame 72 is rotatably supported by a steering shaft supporting portion 74 (FIG. 13) provided on the unit frame 71. An axis of the steering shaft 73 constitutes a steering axis J'. As a result, the swingable frame 72 is swingable relative to the unit frame 71 (the secondary transfer opposite roller 12).

The steering arm 81 (part (a) of FIG. 12) is supported by the unit frame 71 so as to be rotatable about the arm rotation shaft 82 provided on the rear side plate of the unit frame 71. On the rear side plate of the unit frame 71, an eccentric cam 83 (part (a) of FIG. 12) is provided. The steering arm 81 is urged by a steering spring 84 as an urging means so as to contact this eccentric cam 83. The eccentric cam 83 is rotationally driven by a steering motor 85 as a driving source, and an angular position of the steering arm 81 with respect to a swing direction is determined depending on a stop position thereof. In this embodiment, the steering driving portion 80 is constituted by the steering arm 81, the eccentric cam 83, the steering spring 84, the steering motor 85 and the like.

Further, the belt unit 10 is provided with a sensor unit 90 as a position detecting means for detecting a position of an end portion (front-side end portion in this embodiment) of the intermediary transfer belt 10 with respect to the widthwise direction of the intermediary transfer belt 11. In this embodiment, the sensor unit 90 is constituted by including a sensor flag 91 and a plurality of photo-interrupters 92. The sensor flag 91 is supported by the swingable frame 72 so as to be rotatable (swingable) about a flag rotation shaft 91*c*. At one end portion of the sensor flag 91, a rotatable detecting roller 91*a* is provided, and at the other end portion of the sensor flag 91, a light-blocking portion 91*b* for light-blocking the photo-interrupters 92 depending on an angular position thereof with respect to a rotational direction is provided. The sensor flag 91 contacts the front-side end portion of the intermediary transfer belt 11 and is rotated with generation of the belt shift. Then, the light-blocking portion 91*b* light-blocks the photo-interrupters 92 depending on a feeding position of the intermediary transfer belt 11 with respect to the widthwise direction and thus is capable of detecting the feeding position. A controller 120 (part (b) of FIG. 12) actuates the steering motor 85 depending on an output signal of the photo-interrupters 92 and swings the steering roller 13. As a result, a widthwise position of the intermediary transfer belt 11 is corrected with circulatory movement of the intermediary transfer belt 11.

In this embodiment, the steering unit 1 is constituted by the steering roller 13, the swingable frame 72, the steering driving portion 80, the sensor unit 90, the controller 120 and the like which are described above.

In this embodiment, similarly as in Embodiment 1, the cleaning device 30 is held by the steering unit 1 (specifically by the swingable frame 72) so as to be swingable together with the steering unit 1. In this embodiment, the discharging portion 35 provided with the discharge opening 35*a* is provided at the front-side longitudinal end portion of the cleaning device 30. In this embodiment, similarly as in Embodiment 1, in the apparatus main assembly 110, the feeding portion 52 which constitutes, together with the collecting container 51, the collecting portion 50 and which is provided with the receiving opening 50*a* is provided. In this embodiment, similarly as in Embodiment 1, the discharge opening 35*a* of the cleaning device 30 and the receiving opening 50*a* of the collecting portion 50 are caused to communicate with each other by the communicating member 40. The structure of the communicating member 40 in this embodiment is substantially the same as that of the communicating member 40 in Embodiment 1. However, the shape and the like of the upper engaging portion 41 are adapted to the discharging portion 35 of the cleaning device 30 in this embodiment.

When the shift of the intermediary transfer belt 11 generates due to a fluctuation of the load on the belt unit 10 during the image formation, the widthwise end portion position of the intermediary transfer belt 11 is detected by the sensor unit 90. On the basis of information thereof, the controller 120 causes the steering driving portion 80 to swing the steering roller 13 about the steering axis J' in a range of a predetermined angle θ°, and thus corrects the belt shift. At that time, the tube-shaped portion 43, of the communicating member 40, constituted by the bellows-shaped elastic member expands and contracts without substantially exerting a load on the steering operation and is capable of maintaining the communication between the discharge opening 35*a* and the receiving opening 50*a*.

Further, also in this embodiment, similarly as in Embodiment 1, downsizing of the structure of the toner delivering portion from the cleaning device 30 toward the collecting portion 50 provided in the apparatus main assembly 110 can be realized, so that downsizing of the image forming apparatus 100 can be realized. Further, also in this embodiment, similarly as in Embodiment 1, there is no need that a sealing member is separately provided for suppressing leakage of the toner from the delivering portion of the toner from the cleaning device 30 toward the collecting portion 50 provided in the apparatus main assembly 110, or necessity thereof can be reduced.

As described above, the present invention is also applicable to the constitution in which the steering unit 1 is driven by the actuator as in this embodiment, so that an effect similar to the effect of Embodiment 1 can be obtained.

In this embodiment, the steering unit 1 swings the steering roller 13 by moving vertically one end portion of the steering roller 13 with respect to the rotational axis direction of the steering roller 13, but for example, a constitution in which the steering roller 13 is swung by moving opposite end portions thereof in opposite directions to each other may also be employed.

Embodiment 3

Next, Embodiment 3 of the present invention will be described.

(Image Forming Apparatus)

FIG. 15 is an illustration of an image forming apparatus 1100 in this embodiment. As shown in FIG. 15, the image forming apparatus 1100 is a tandem color digital printer of an intermediary transfer type in which four image forming portions 1109 are provided along an intermediary transfer belt 1101.

Photosensitive drums 1103 as four image bearing members are electrically charged uniformly at their surfaces by charging rollers 1104, respectively. Into laser scanners 1105, image signals for yellow, magenta, cyan and black are inputted, respectively, and drum surfaces are irradiated with laser light (beams) depending on the image signals, and electric charges are neutralized, so that latent images are formed. The latent images formed on the drum surfaces are developed with toners of yellow, magenta, cyan and black, respectively, by developing devices 1106. The toner images formed on the drums by development are successively primary-transferred onto the surface of the intermediary transfer belt 1101 by primary transfer rollers 1107. Transfer residual toners on the photosensitive drums 1103 are collected by drum cleaners 1108.

On the other hand, a recording material P such as paper fed from a cassette sheet feeding portion 1120 by a sheet feeding roller pair 1121 is conveyed toward a registration roller pair 1122 and then are conveyed toward a secondary transfer portion T2 in synchronism with the toner images on the intermediary transfer belt 1101. The toner images on the intermediary transfer belt 1101 are transferred onto the recording material P at the secondary transfer portion T2 by an inner secondary transfer roller 1110 and an outer secondary transfer roller 1111, and then is sent toward a fixing device 1130. The recording material P sent to the fixing device 1130 is discharged to an outside of the image forming apparatus 1100 after the toner images are fixed on the recording material P by the fixing perspective view 1130 under application of heat and pressure. Transfer residual toner on the intermediary transfer belt 1101 which is not transferred onto the recording material P at the secondary transfer portion T2 is collected by an intermediary transfer belt cleaner unit 1102.

(Intermediary Transfer Unit)

Parts (a), (b) and (c) of FIG. 16 are illustrates of an intermediary transfer unit 1200. The intermediary transfer unit 1200 is a belt feeding device including the intermediary transfer belt 1101 as an intermediary transfer member which is stretched by a plurality of stretching rollers and which is rotated and fed by the stretching rollers. The intermediary transfer belt 1101 is an endless belt member using polyimide or the like. The intermediary transfer belt 1101 is stretched by a driving roller 1110, a steering roller 1112, stretching rollers 1113 and 1114 and primary transfer rollers 1107 which are rotatably supported by a part of a frame 1201 and are integrally assembled, and these component parts constitute the intermediary transfer unit 1200. The driving roller 1110 as a first roller also functions as an inner secondary transfer roller forming the secondary transfer portion T2. The steering roller 1112 as a second roller is urged so as to press the intermediary transfer belt 1101 from an inner surface thereof by a compression spring 1213 and also functions as a tension roller for imparting tension to the intermediary transfer belt 1101.

As shown in part (a) of FIG. 16, the primary transfer rollers 1107 form primary transfer portions T1 in combination with the photosensitive drums 1103 through the intermediary transfer belt 1101 and form a color image by superposing and transferring toner images of yellow, magenta, cyan and black on the intermediary transfer belt 1101. On the other hand, during monochromatic image formation, as shown in part (b) of FIG. 16, the primary transfer rollers 1107 for yellow, magenta and cyan, the intermediary transfer belt 1101 and the photosensitive drums 1103 for yellow, magenta and cyan are separated from each other by an unshown raising and lowering mechanism, and then the photosensitive drums 1103 for yellow, magenta and cyan are stopped. Then, a monochromatic toner image is formed on the intermediary transfer belt 1101 by the primary transfer roller 1107 for black and the photosensitive drum 1103 for black which form the primary transfer portion T1 through the intermediary transfer belt 1101. In a stand-by state of the image forming apparatus 1100, as shown in part (c) of FIG. 16, the primary transfer roller 1107 for black and the stretching roller 1114 are also moved, so that the intermediary transfer belt 1101 is placed in a state of being completely separated from the four photosensitive drums 1103.

(Steering Mechanism)

FIG. 17 is a perspective view of a steering mechanism of the intermediary transfer unit 1200, and parts (a), (b) and (c) of FIG. 18 are illustrates of an operation of the steering mechanism.

A steering unit as the steering mechanism includes the steering roller 1112, a steering roller supporting member 1211 rotatably supporting the steering roller 1112, and a rotation shaft 1214. The steering unit is pivotably supported by the frame 1201 through the rotation shaft 1214. The steering unit is provided downstream of the frame 1201 with respect to a mounting direction of the intermediary transfer unit 1200.

The steering roller 1112 is supported at opposite end portions thereof by the steering roller supporting member 1211 constituting the steering unit so that the steering roller 1112 is rotated with rotation of the intermediary transfer belt 1101. At the opposite end portions of the steering roller 1112, sliding ring portions 1212 of which rotation is restricted. In this embodiment, the sliding ring portions 1212 include bearings 1212*a* and also function as bearing members of the steering roller 1212. Further, the sliding ring portions (bearing members) 1212 are slidably supported in an arrow X direction by the steering roller supporting members 1211, so that the steering roller 1112 is surged against the intermediary transfer belt 1101 by the compression springs 1213. The sliding ring portions 1212 are provided at the end portions of the steering roller 1112 with respect to an axial direction of the steering roller 1112. The steering roller supporting member 1211 is pivotably supported by the frame 1201 through the rotation shaft 1214. The rotation shaft 1214 pivotably supports the steering roller supporting member 1211 constituting the steering unit about an axis crossing an axis of the steering roller 1112 relative to the frame 1201 as a frame member.

A state shown in part (a) of FIG. 18 is a state in which the intermediary transfer belt 1101 is stretched with a good balance with respect to a center of the steering roller 1112 with respect to the axial direction of the steering roller 1112. From the state shown in part (a) of FIG. 18, when a shift of the intermediary transfer belt 1101 toward a leftward direction (one direction of the axial direction) generates as shown in part (b) of FIG. 18, a frictional force generates between the intermediary transfer belt 1101 and each of the sliding ring portions 1212 provided at the opposite end portions. At this time, bearing widths between the intermediary transfer belt 1101 and the opposite sliding ring portions 1212 are different from each other on left and right sides, so that the frictional force on the left side (one side with respect to the axial direction) is larger than the frictional force on the right side (the other side with respect to the axial direction), and thus the steering roller 1112 is pivoted in a direction in which the left side of the steering roller 1112 lowers. As a result, the driving roller 1110 and the steering roller 1112 go out of alignment, so that the intermediary transfer belt 1101 generates a belt shift toward the right side at a winding portion of the steering roller 1112 around the intermediary transfer belt 1101, and thus the shift of the belt position is corrected. Further, as shown in part (c) of FIG. 18, in the case where the shift toward the right direction (the other direction of the axial direction) occurs, the frictional force between the intermediary transfer belt 1101 and the sliding ring portion 1212 on the right side (the other side with respect to the axial direction) becomes large, so that the steering roller 1112 pivots in a direction in which the right side of the steering roller 1112 lowers. As a result, the intermediary transfer belt 1101 generates the belt shift toward the left side (one side with respect to the axial direction) at a winding portion of the steering roller 1112 around the intermediary transfer belt 1101, so that the shift of the belt position is corrected.

In the intermediary transfer unit 1200, in general, when the intermediary transfer belt 1101 is rotationally driven, the belt shift occurs in one direction by influences such as a deviation of alignment of the stretching rollers and a slight longitudinal distribution of a roller diameter. However, when a balance of the frictional forces between the intermediary transfer belt 1101 and the opposite sliding ring portions 1212 is gradually changed correspondingly and the steering roller 1112 is pivoted, a shifting speed of the intermediary transfer belt 1101 is gradually decreased and settles in a steering pivot attitude in which the belt shift is balanced.

(Intermediary Transfer Belt Cleaner Unit)

FIG. 19 is an illustration of a mounting state of the intermediary transfer belt cleaner unit 1102. The steering unit pivotably supported by the frame 1201 includes the intermediary transfer belt cleaner unit 1102 as a cleaning unit for cleaning the intermediary transfer belt 1101 in contact with the intermediary transfer belt 1101 at a position opposing the steering roller 1112.

The intermediary transfer belt cleaner unit 1102 includes a cleaning blade 1031 as a cleaning member for collecting the toner in contact with the intermediary transfer belt 1101 and includes a discharge opening 1035 which is provided on one end side thereof with respect to the axial direction of the steering roller 1112 and which permits discharge of the toner through the discharge opening 1035. The intermediary transfer belt cleaner unit 1102 is fixed to the steering unit and is provided together with the intermediary transfer unit 1200 so as to be mounted to and dismounted from the image forming apparatus 1100.

The intermediary transfer belt cleaner unit 1102 causes a free end of the cleaning bade 1031 to contact the intermediary transfer belt 1101 at a position opposing the steering roller 1112 so as to form a contact pressure by elastic deformation of the cleaning blade 1031, and causes the cleaning blade 1031 to collect the transfer residual toner on the intermediary transfer belt 1101. As described above, the steering roller 1112 is rotatably supported at opposite end portions thereof by the sliding ring portions (bearing members) 1212 and is slidably supported by the steering roller supporting member 1211 via the compression springs 1213. The intermediary transfer belt cleaner unit 1102 is fixed to the sliding ring portions 1212 at opposite end portions thereof, so that the intermediary transfer belt cleaner unit 1102 is integrated with the steering roller 1112 and pivoted together with the steering roller supporting member 1211. That is, the cleaning blade 1031 is press-contacted to the intermediary transfer belt 1101 at a certain position so as to always maintain a parallel state even in the case where the steering roller 1112 is pivoted by generation of the shift of the intermediary transfer belt 1101, and thus is capable of stably maintain a friction state with the intermediary transfer belt 1101.

Further, a cleaner container 1034 supporting the cleaning blade 1031 includes a first projection 1034*a* and a second projection 1034*b*, which are used for connection with an intermediary feeding unit (described later).

The first projection 1034*a* is a contact portion for moving a connecting member 1302 to a predetermined position against an elastic force of a bellows pipe (bellows-shaped pipe) in contact with the connecting member 1302 by movement of the intermediary transfer unit 1200 in the mounting direction. The second projection 1034*b* is an engaging portion engaging with the connecting member 1302 with a mounting operation of the intermediary transfer unit 1200 after the connecting member 1302 is moved to the predetermined position. Specifically, the first projection 1034*e* contacts the connecting member 1032 (FIG. 27) on an intermediary feeding unit side described latera by the movement of the intermediary transfer unit 1200 in the mounting direction (an arrow direction of FIG. 27), and presses downward the connecting member 1302 with respect to a direction (arrow Z direction of FIG. 22) crossing the mounting direction. The second projection 1034*b* engages with the connecting member 1302 pushed downward by the first projection 1034*a* and connects the intermediary transfer belt cleaner unit 1102 and the intermediary feeding unit, so that positioning of the intermediary transfer belt cleaner unit 1102 with respect to a direction (arrow Z direction of FIG. 22) crossing the mounting direction is carried out.

FIG. 20 is a sectional view of the intermediary transfer belt cleaner unit 1102 and an intermediary transfer belt cleaner supporting portion. The transfer residual toner on the intermediary transfer belt 1101 is scraped off by the cleaning blade 1031 supported by the cleaner container 1034 and is collected in the cleaner container 1034. The collected toner collected in the cleaner container 1034 drops by self-weight thereof in a collected toner feeding path 1032 provided in the cleaner container 1034. The collected toner dropped in the collected toner feeding path 1032 provided in the cleaner container 1034 is fed toward one end portion (frontward direction in FIG. 20) with respect to a longitudinal direction of the cleaner container 1034 by a connected toner feeding screw 1033 provided in the connected toner feeding path 1032. Thereafter, the collected toner reaches the discharge opening 1035 provided at one end portion (the end portion with respect to the frontward direction in FIG. 20) with respect to the longitudinal direction of the cleaner container 1034 and passes through an intermediary feeding unit 1300 (described later), and then is accommodated in a collected toner box (not shown) provided in an image forming apparatus main assembly.

The intermediary transfer belt cleaner unit 1102 and the steering unit are supported by the frame of the intermediary transfer unit through the rotation shaft 1214 as described above, but are subjected to a force substantially in the direction of gravitation by self-weights, the belt tension and elastic reaction force of the cleaning blade 1301. When an excessive bending force generates in the frame 1201 (FIG. 17) supporting the rotation shaft 1214, the frame 1201 is deformed, so that the intermediary transfer belt cleaner unit 1102 and the steering unit are displaced downward so as to sag. As a result, the displacement leads to inconveniences such as a lowering in belt shift returning power due to prevention of the steering operation and an image defect due to that a desired belt tension is not imparted.

Therefore, in this embodiment, the intermediary transfer belt cleaner unit 1102 and the steering unit are supported substantially horizontally by a supporting portion 1036 provided into image forming apparatus 1100 through a cleaning blade holder 1037 bearing the cleaning blade 1031.

The supporting portion 1036 is provided on an apparatus main assembly of the image forming apparatus 1100 and supports the steering unit pivotably around an axis crossing an axis of the steering roller 1112 relative to the frame of the image forming apparatus 1100. The supporting portion 1036 point-contacts the cleaning blade holder 1037 coaxially with the rotation shaft 1214 so as not to prevent the pivot of the steering roller 1112. The supporting portion 1036 slides with the cleaning blade holder 1037 when the intermediary transfer unit 1200 is mounted in and dismounted from the image forming apparatus 1100, and therefore it is desirable that a material high in sliding properly, such as polyacetal (POM) is used.

(Intermediary Feeding Unit)

FIG. 21 is a perspective view of the intermediary transfer unit 1200 including the intermediary transfer belt cleaner unit 1102, and of the intermediary feeding unit 1300 and the supporting portion 1036 in a state in which these units are portion are mounted in the image forming apparatus 1100. FIG. 22 is a perspective view of the intermediary feeding unit 1300.

The intermediary feeding unit 1300 includes a connecting member 1302, a feeding pipe 1303, a bellows pipe 1304 and a feeding screw 1305. The connecting member 1302 is supported slidably in an arrow Z direction by a connecting member guide 1301 provided in the image forming apparatus 1100. Here, the arrow Z direction is a pivoting direction of the steering unit and is also an expansion and contraction direction of the bellows pipe 1304, and is a direction crossing the mounting direction (arrow direction of FIG. 27) of the intermediary transfer unit 1200. The connecting member 1302 connects the discharge opening 1035 of the cleaner container 1034 and the bellows pipe 1304. The feeding pipe 1303 is provided in the image forming apparatus 1100 and is provided with the feeding screw 1305 therein. The bellows pipe 1304 is a bellows-shaped tube-like member constituted by a rubber. This bellows pipe 1304 is engaged with the connecting member 1302 and is connected with the feeding pipe 1303 provided in the image forming apparatus 1100. The bellows pipe 1304 is an elastic member capable of deformation (expansion and contraction) in the arrow Z direction in order to connect the feeding pipe provided in the image forming apparatus 1100 and the intermediary transfer belt cleaner unit 1102 pivotably supported by the intermediary transfer unit 1200. The bellows pipe 1304 may desirably have small elastic reaction force so as not to prevent the pivot of the intermediary transfer belt cleaner unit 1102. In this embodiment, the bellows pipe 1304 is capable of expansion and contraction in the arrow Z direction in FIG. 22. Specifically, the bellows pipe 1304 is expanded and contracted by ±5.5 mm in the arrow Z direction at the time of maximum pivot of the steering roller 1112 and the intermediary transfer belt cleaner unit 1102, and the elastic reaction force at that time is set at 50 gf or less.

Further, the connecting member 1302 includes a first receiving portion 1302*a* contacting the first projection 1034*a* provided on the cleaner container 1034 and a second receiving portion 1302*b* engaging with the second projection 1034*b* provided on the cleaner container 1304. The first receiving portion 1302*a* contacts the first projection 1034*a* provided on the cleaner container 1034 and is pushed downward in the direction (arrow direction of FIG. 27) crossing the mounting direction by movement of the first projection 1034*a* in the mounting directions (arrow direction of FIG. 27). The second receiving portion 1302*b* is pushed downward to a position where the second receiving portion 1302*b* is engageable with the second projection 1034*b* moved in the mounting direction by pushing downward the connecting member 1032 by the first projection 1034*a*. The second perspective viewing portion 1032*b* connects the discharge opening 1035 of the intermediary transfer belt cleaner unit 1102 and the bellows pipe of the intermediary feeding unit 1300 by being engaged with the second projection 1034*b* moved in the mounting direction, and is in a state in which the second receiving portion 1302*b* is movable by following the pivot of the intermediary transfer belt cleaner unit 1102.

Further, in a state in which the intermediary transfer unit 1200 including the intermediary transfer belt cleaner unit 1102 is not mounted in the image forming apparatus 1100, a position of the connecting member 1302 engaged with the bellows pipe 1304 with respect to the arrow Z direction is determined in the following manner. That is, the position of the connecting member 1302 with respect to the arrow Z direction is determined by a relationship between the self-weight of the connecting member 1302 and the elastic reaction force determined by a rubber hardness and a thickness of the bellows pipe 1304. The self-weight of the connecting member 1302 and the elastic reaction force of the bellows pipe 1304 are set so that the position of the first receiving portion is between an uppermost position and a lowermost position of the first projection 1034*a* provided on the cleaner container 1034 in a center alignment range of the pivot of the intermediary transfer belt cleaner unit 1102. In other words, the following constitution is employed. That is, the steering roller 1112 is pivotable between a first pivot angle and a second pivot angle. For example, when a pivot angle of the steering roller 1112 is the first pivot angle, an end portion position where the discharge opening 1035 of the cleaner container 1034 is provided is the uppermost position. On the other hand, when the pivot angle of the steering roller 1112 is the second pivot angle, the end portion position where the discharge opening 1035 of the cleaner container 1034 is provided is the lowermost position. Further, in the case where the pivot angle of the steering roller 1112 is the first pivot angle, the bellows pipe 1304 is expanded and, by a restoring force thereof, the bellows pipe 1304 is constituted so that the steering roller 1112 receives a force in a direction in which the steering roller 1112 moves toward the second pivot angle. Further, in the case where the pivot angle of the steering roller 1112 is the second pivot angle, the bellows pipe 1304 is contracted (compressed) and, by the restoring force thereof, the bellows pipe 1304 is constituted so that the steering roller 1112 receives a force in a direction in which the steering roller 1112 moves toward the first pivot angle. By employing such a constitution, for example, even at any pivot angle of the steering roller 1112, it is possible to avoid that the bellows pipe 1304 is always contracted (compressed) or is always expanded.

(Guiding Rail)

As shown in FIG. 23, the image forming apparatus 1100 includes four image forming portions 1109 which are juxtaposed and is provided with an opening 1140 at one side surface, and the intermediary transfer unit 1200 is integrally mountable in and dismountable from an inside of a casing of the image forming apparatus 1100 through the opening 1140. At this one side surface of the image forming apparatus 1100, an openable member 1115 openable relative to the image forming apparatus 1100 is provided, and the opening 1140 is opened by opening the openable member 1115. Incidentally, in this embodiment, this openable member 1115 is provided with an outer secondary transfer roller 1111 opposing a driving roller (inner secondary transfer roller) 1110 of the intermediary transfer unit 1200 and with one of a registration roller pair 1122. Accordingly, by opening the openable member 1115, a feeding path which is a transfer-receiving member is also opened.

FIG. 24 is an illustration of the image forming apparatus 1100 as seen from the opening 1140 side. As shown in FIG. 24, in a casing (apparatus main assembly) of the image forming apparatus 1100, side plates 1151 and 1152 which oppose each other are connected by a plurality of stays 1153. The intermediary transfer unit 1200 is provided with guiding ribs (first portions-to-be-guided) 1201 and 1203 on side surfaces on opposite sides of a frame 1201 with respect to an axial direction of stretching rollers. On inner wall surfaces of the side plates 1151 and 1152 of the image forming apparatus 1100, guiding rails (first guiding portions) 1161 and 1162 for holding the guiding rib 1202 and 1203, respectively, are provided opposed to the guiding rib 1202 and 1203. Further, in the image forming apparatus 1100 shown in FIG. 23, the four image forming portions 1109 containing the photosensitive drums 1103 are disposed below the intermediary transfer unit 1200, and are rotationally driven by a driving unit 1170 provided on one side plate 1152 through a coupling 1171 as shown in FIG. 24. Accordingly, when the intermediary transfer unit 1200 is mounted and dismounted, as shown in FIG. 23, the intermediary transfer unit 1200 passes through above the image forming portions 1109 in an arrangement direction of the image forming portions 1109.

FIG. 25 is a perspective view showing a state in which the intermediary transfer unit 1200 is mounted on the guiding rail 1162. In actuality, the guiding rail 1161 is disposed at an opposing position to the guiding rail 1162, but a side surface of the intermediary transfer unit 1200 is displayed, and therefore, in FIG. 25, the guiding rail 1161 is not shown.

FIG. 26 is an illustration of the guiding rail 1162. At the opposing position to the guiding rail 1162, as described above, the guiding rail 1161 is disposed, but is not shown also in FIG. 26. A position of a first guiding rail 1161*a*, with respect to the arrow Z direction of FIG. 28, which is described later and which is provided on the guiding rail 1161 disposed at the opposing position to the guiding rail 1162 is the same as a position of a first guiding rail 1162*a* provided on the guiding rail 1162. A second guiding rail 1161*b* which is not shown in FIG. 26 guides a guiding projection 1215, and therefore is different in position with respect to the arrow Z direction of FIG. 28, from a second guiding rail 1162*b* for guiding a guiding projection 1216. However, together with the second guiding rail 1162*b* for guiding the guiding projection 1216, the second guiding rail 1161*b* for guiding the guiding projection 1215 not only restricts the pivot of the cleaner but also eliminates the restriction of the pivot at the same timing.

The intermediary transfer unit 1200 is supported by engaging guiding ribs 1202*a*, 1202*b*, 1203*a* and 1203*b* provided on opposite side surfaces of the frame 1202 with the first guiding rails 1161*a* and 1162*a* provided on the guiding rails 1161 and 1162 on the image forming apparatus 1100 side. As a result, an attitude of the intermediary transfer unit 1200 during mounting and dismounting thereof is regulated, so that an inconvenience such that the intermediary transfer belt 1101 is damaged is prevented by avoiding contact with peripheral members such as the image forming portions 1109 disposed below the intermediary transfer belt 1101 and the stay 1153 disposed above the intermediary transfer belt 1101.

On the other hand, in the intermediary transfer unit 1200, attitudes of the steering unit and the intermediary transfer belt cleaner unit 1102 which are provided pivotably relative to the frame 1201 are not sufficiently regulated by the guiding ribs 1202*a*, 1202*b*, 1203*a* and 1203*b*. That is, when the steering roller 1112 is pivoted depending on the shift position of the intermediary transfer belt 1101, end portions of the steering unit and the intermediary transfer belt cleaner unit 1102 on the shift direction side of the intermediary transfer belt 1101 lower. Then, there is a liability that during the mounting and dismounting of the intermediary transfer unit 1200, the steering unit and the intermediary transfer belt cleaner unit 1102 contact the image forming portions 1109 disposed below the intermediary transfer unit 1200. Or, there is a liability that positions of the first projection 1034*a* and the second projection 1034*b* provided on the cleaner container 1034 vary and thus improper connection between the intermediary transfer belt cleaner unit 1102 and the connecting member 1302 occurs.

Therefore, in this embodiment, as shown in FIGS. 19 and 26, at opposite end portions of the intermediary transfer belt cleaner unit 1102, guiding projections (second portions-to-be-guided) 1215 and 1216 are provided, respectively. As shown in FIG. 19, the guiding projection 1215 is provided on one side of the intermediary transfer belt cleaner unit 1102 with respect to the longitudinal direction (axial direction of the steering roller 1112). The side where this guiding projection 1215 is provided is a side where the intermediary transfer belt cleaner unit 1102 is connected with the intermediary feeding unit 1300 shown in FIG. 21. On the other hand, the guiding projection 1216 is provided on the other side of the intermediary transfer belt cleaner unit 1102 with respect to the longitudinal direction.

Further, the guiding rails 1161 and 1162 are provided in the second guiding rails (second guiding portions) 1161*b* and 1162*b*, respectively, engaging with the guiding projections 1215 and 1216, respectively. Here, the second guiding rails 1161*b* and 1162*b* engage with the guiding projections 1215 and 11216 during passing of the steering unit and the intermediary transfer belt cleaner unit 1102 from a mounting start position on the opening 1140 side of the image forming apparatus 1100 through above the image forming portions 1109 and regulate the attitudes of the steering unit and the intermediary transfer belt cleaner unit 1102. However, the second frames 1161*b* and 1162*b* eliminate engagement thereof with the guiding projections 1215 and 1216 of the intermediary transfer belt cleaner unit 1102 at a position A in front of a mounting position (mounting completion position) after the steering unit and the intermediary transfer belt cleaner unit 1102 pass through above the image forming portions 1109. As a result, at the mounting position of the intermediary transfer unit 1200, the attitudes of the steering unit and the intermediary transfer belt cleaner unit 1102 are pivotable, so that steering against the shift of the intermediary transfer belt 1101 is enabled.

(Connecting Process Between Intermediary Transfer Belt Cleaner Unit and Connecting Member)

A connecting process unit connection between the intermediary transfer belt cleaner unit 1102 and the connecting member of the intermediary feeding unit 1300 during the mounting of the intermediary transfer unit 1200 in the image forming apparatus 1100 is completed will be described. In the following description, the process until the connection is completed will be described in stages.

(Connecting Process Position 1)

FIG. 27 is an illustration of the intermediary transfer belt cleaner unit 1102 and the intermediary feeding unit 1300 in a state (connecting process position 1) before connection therebetween is started. In the connecting process position 1 shown in FIG. 27, the intermediary transfer belt cleaner unit 1102 supported pivotably by the frame 1201 are guided at the guiding projections 1215 and 1216 by the guiding rails 1161*b* and 1162*b*. For this reason, the intermediary transfer belt cleaner unit 1102 supported pivotably relative to the frame 1201 is regulated in pivot attitude by the second guiding rails 1161*b* and 1162*b* provided on the guiding rails 1161 and 1162. Further, the position of the connecting member 1302 of the intermediary feeding unit 1300 with respect to the arrow Z direction is a position where the elastic reaction force of the bellows pipe 1304 and the self-weight of the connecting member 1302 are balanced with each other as described above. In this embodiment, the connecting member 1302 is positioned above a connecting position shown in FIG. 29 by a predetermined distance d (mm). That is, the connecting member 1302 is disposed so that a second receiving portion 1302*b* thereof is positioned above the second projection 1034*b* provided on the cleaner container 1034 by the predetermined distance d in the figure. Accordingly, when the intermediary transfer unit 1200 is intended to be mounted in the image forming apparatus 100 as it is, improper connection thereof with the intermediary transfer belt cleaner unit 1102 can occur.

(Connecting Process Position 2)

Therefore, before the second projection 1034*b* and the second receiving portion 1302*b* start engagement therebetween, at a connecting process position 2 shown in FIG. 28, the first projection 1034*a* provided on the cleaner container 1034 contacts the first receiving portion 1302*a* provided on the connecting member 1302 by movement of the intermediary transfer unit 1200 in the mounting direction and thus pushes downward the connecting member 1302 in the arrow Z direction crossing the mounting direction. As a result, the second receiving portion 1302*a* of the connecting member 1302 and the second projection 1034*b* of the cleaner container 1034 are positionally aligned with each other, so that engagement therebetween is carried out with reliability. FIG. 28 shows a state (connecting process position 2) in which the first projection 1034*a* provided on the cleaner container 1034 contacts the first perspective viewing portion 1302*a* provided on the connecting member 1302 by movement of the intermediary transfer unit 1200 in the mounting direction and thus pushes downward the connecting member 1302 in the arrow Z direction. By the contact between the first projection 1034*a* and the first receiving portion 1302*a*, the bellows pipe 1304 engaging with the connecting member 1302 is contracted (compressed) downward in the arrow Z direction. As a result, positional alignment of the second receiving portion 1302*b* of the connecting member 1302 with the second projection 1304*b* of the cleaner container 1304 in the arrow Z direction can be carried out.

(Connection Completion Position)

FIG. 29 is an illustration showing a state in which the second projection 1034*b* of the cleaner container 1034 and the second receiving portion 1302*b* are engaged with each other and connection between the intermediary transfer belt cleaner unit 1102 and the intermediary feeding unit 1300 is completed. After the first projection 1034*a* contacts the first receiving portion 1302*a* and pushes downward the connecting member 1302 in the arrow Z direction, as shown in FIG. 29, the second projection 1034*b* provided on the cleaner container 1034 engages with the second receiving portion 1302*b* provided on the connecting member 1302. Then, after the second projection 1034*b* engages with the second receiving portion 1032*b*, by further movement of the intermediary transfer belt cleaner unit 1102, the first projection 1034*a* separates from the first receiving portion 1302*a* and contact between the first projection 1034*a* of the cleaner container 1034 and the first receiving portion 1302*a* of the connecting member 1032 is eliminated. In addition, by the movement of the intermediary transfer belt cleaner unit 1102 in the mounting direction after the second projection 1034*b* engages with the second receiving portion 1302*b*, as shown in FIG. 29, the discharge opening 1035 of the cleaner container 1034 and the bellows pipe 1304 are connected with each other. Further, at a connection completion position shown in FIG. 29, the supporting portion 1036 on the image forming apparatus side contacts a cleaning blade holder 1037 as shown in FIG. 20 and supports pivotably the intermediary transfer belt cleaner unit 1102 of which support by the guiding projections 1215 and 1216 is eliminated.

Incidentally, engagement of the guiding projections 1215 and 1216 provided on the cleaner container 1034 with the guiding rails 1161*b* and 1162*b* provided on the guiding rails 1161 and 1162 is eliminated after the second projection 1034*b* engages with the second receiving portion 1032*b*. As a result, the pivot of the intermediary transfer belt cleaner unit 1102 in a state in which the mounting of the intermediary transfer belt cleaner unit 1102 into the image forming apparatus 1100 is completed is not prevented.

As described above, according to this embodiment, in a mounting process of the intermediary transfer belt cleaner unit into the image forming apparatus, the bellows pipe capable of expansion and contraction between the cleaner container and the intermediary feeding unit is pushed downward in the direction of gravitation by the first projection of the cleaner container through the connecting member and thereafter connection thereof with the cleaner container is completed by the second projection. For that reason, the intermediary transfer belt cleaner unit capable of mounting is and demounting from the image forming apparatus can be reliably connected, in the mounting process thereof with the bellows pipe which is provided on the image forming apparatus side and which is capable of expansion and contraction.

Embodiment 4

In Embodiment 3 described above, the constitution in which the position, with respect to the arrow Z direction, of the guiding projections (second portions-to-be-guided) 1215 and 1216 provided on the cleaner container 1034 is restricted to the same position (level) until the second projection 1034*b* engages with the second receiving portion 1302*b* was described as an example, but the present invention is not limited thereto.

In this embodiment, a constitution in which the position, with respect to the arrow Z direction, of the guiding projection (second portion-to-be-guided) 1215 provided on the cleaner container 1034 is restricted to a position (level) below the other guiding projection 1216 before the first projection 1034*a* contacts the first receiving portion 1302*a*. In the following, the constitution will be described using parts (a) and (b) of FIG. 30. Part (a) of FIG. 30 is an illustration of a guiding rail 1162 on a rear side of an apparatus main assembly in this embodiment, in which the guiding rail 1162 includes a second guiding groove 1162*b*. Part (b) of FIG. 30 is an illustration of a guiding projection 1161 on a front side of the apparatus main assembly in this embodiment, in which the guiding rail 1161 includes a second guiding groove 1161*b*.

In this embodiment, as shown in part (a) of FIG. 30, the guiding rail 1162 on the rear side of the apparatus main assembly is provided with the second guiding groove 1162*b* as a second guiding portion. Further, as shown in part (b) of FIG. 30, the guiding rail 1161 on the front side of the apparatus main assembly is provided with the second guiding groove 1161*b* as a second guiding portion. In the above-described Embodiment 3, as the second guiding portions, the guiding rails for restricting the positions of the guiding projections from below with respect to the arrow Z direction were described as an example, but in this embodiment, the guiding grooves for restricting the positions of the guiding projections from above and below with respect to the arrow Z direction are used. For this reason, shapes of the guiding projections 1215 and 1216 as the second portions-to-be-guided provided at opposite end portions of the intermediary transfer belt cleaner unit 1102 are different from those in Embodiment 3 and are cylindrical shapes capable of being restricted (regulated) from above and below with respect to the arrow Z direction by the guiding grooves are shown in parts (a) and (b) of FIG. 30.

The guiding rail 1161 shown in part (b) of FIG. 30 is provided on one side of the image forming apparatus 1100 shown in FIG. 24 with respect to an axial direction (direction of an axis 1112*a* shown in FIG. 17) of the steering roller 1112. Further, the guiding rail 1162 shown in part (b) of FIG. 30 is provided opposed to the guiding rail 1161 with respect to the axial direction of the steering roller 1112 and is disposed on the other side opposite to the above-described one side of the image forming apparatus 1100 shown in FIG. 24. Incidentally, the other side of the image forming apparatus 1100 where the guiding rail 1162 is provided is a rear side Rr of the image forming apparatus 1100 where a driving unit 1170 is provided as shown in FIG. 24. Further, the above-described one side of the image forming apparatus 1100 where the guiding rail 1161 is provided is a side where the intermediary feeding unit 1300 (FIG. 21) including the bellows pipe 1304 and the connecting member 1302 is provided, and is a front side Fr of the apparatus main assembly opposite from the rear side Rr of the apparatus main assembly where the driving unit 1700 is provided.

The guiding groove 1161*b* on the above-described one side (front side Fr of the apparatus main assembly) shown in part (b) of FIG. 30 has a range in which one side of the intermediary transfer belt cleaner unit is pivoted downward relative to the other side of the intermediary transfer belt cleaner unit in a process in which the intermediary transfer unit 1200 is mounted in the image forming apparatus 1100. That is, the guiding groove 1161*b* has a range in which the guiding projection 1215 on one side is pivoted downward relative to the guiding projection 1216 on the other side shown in part (a) of FIG. 30. In this embodiment, the range in which the guiding groove 1161*b* causes the intermediary transfer belt cleaner unit to pivot is set at a range from a position G where the intermediary transfer belt cleaner unit passes through above the image forming portions 1109 to a position C where the support of the guiding projections 1215 and 1216 is eliminated and where the position C is located in front of a mounting position (mounting completion position) A. Incidentally, the position C where the support of the guiding projections 1215 and 1216 is eliminated is similar to the position where the support of the guiding projections is eliminated in the above-described Embodiment 3.

As shown in part (b) of FIG. 30, the guiding groove 1161*b* of the guiding rail 1162 on the front side Fr of the apparatus main assembly gradually changes the position of the guiding projection 1215 from the position G where the intermediary transfer belt cleaner unit 1102 passes through above the image forming portions 1109 toward below with respect to a height direction. At this time, as shown in part (a) of FIG. 30 the guiding groove 1162*b* of the guiding rail 1162 on the rear side Rr of the apparatus main assembly does not change the position of the guiding projection 1216 with respect to the height direction even when the intermediary transfer belt cleaner unit 1102 passes through the position G where the intermediary transfer belt cleaner unit 1102 passes through above the image forming portions 1109. As a result, the guiding projection 1215 on the front side Fr of the apparatus main assembly is lower in position with respect to the height direction than the guiding projection 1216 on the rear side Rr of the apparatus main assembly. Further, as shown in part (b) of FIG. 30, the guiding groove 1161*b* of the guiding rail 1161 on the front side Fr regulates (restricts) the position of the guiding projection 1215 so that the pivot position (attitude) of the intermediary transfer belt cleaner unit 1102 is a lower end at the position C in a center alignment range. Further, the pivot attitude is maintained by the self-weight of the intermediary transfer belt cleaner unit 1102, so that even when the intermediary transfer belt cleaner unit 1102 is in a pivotable position, the intermediary transfer belt cleaner unit 1102 is capable of reliably engaging with the intermediary feeding unit 1300 including the bellows pipe 1304 and the connecting member 1302.

In this embodiment, as described above, the position, with respect to the height direction, of the one guiding projection (second portion-to-be-guided) 1215 provided on the intermediary transfer belt cleaner unit 1102 is regulated to the position below the other guiding projection 1216, and therefore, by further movement of the intermediary transfer belt cleaner unit 1102 in the mounting direction, the first projection 1034*a* contacts the first receiving portion 1302*a* and pushes downward the connecting member 1302. A subsequent operation is similar to the operation in the above-described Embodiment 3, and therefore, will be omitted from description in this embodiment.

Incidentally, in Embodiment 4, a constitution in which the guiding grooves 1161*b* and 1162*b* were provided as the second portion-to-be-guided for guiding the guiding projections provided on the intermediary transfer belt cleaner unit (cleaner container) was described as an example. That is, in FIG. 4, a constitution in which the guiding grooves for restricting the movement of the guiding projections 1215 and 1216 toward above and below with respect to the height direction in the pivot direction of the steering unit and the intermediary transfer belt cleaner unit was described as an example. However, the second portions-to-be-guided for guiding the guiding projections provided on the cleaner container is not limited thereto, but may also be guide-shaped members such as guiding rails for restricting at least movement (downward movement by self-weight) of the guiding projections toward a lower side.

As described above, also in this embodiment, in a mounting process of the intermediary transfer belt cleaner unit into the image forming apparatus, the bellows pipe capable of expansion and contraction between the cleaner container and the intermediary feeding unit is pushed downward in the direction of gravitation by the first projection of the cleaner container through the connecting member and thereafter connection thereof with the cleaner container is completed by the second projection. For that reason, the intermediary transfer belt cleaner unit capable of mounting is and demounting from the image forming apparatus can be reliably connected, in the mounting process thereof with the bellows pipe which is provided on the image forming apparatus side and which is capable of expansion and contraction.

Other Embodiments

The present invention was described above based on the specific embodiments, but is not limited to the above-described embodiments.

In the above-described embodiments, the endless belt is the intermediary transfer belt but may also be a photosensitive (member) belt, (photosensitive member), an electrostatic recording dielectric member belt (electrostatic recording dielectric member) or a feeding belt (recording material carrying member).

Further, in the above-described embodiments, the communicating member is held in the apparatus main assembly of the image forming apparatus, but for example, may also be mountable in and dismountable from the apparatus main assembly, together with the belt unit.

Further, the present invention is not limited to application to the constitution in which the belt feeding device (belt unit) is mountable in and dismountable from the apparatus main assembly of the image forming apparatus but may also be applicable to a constitution in which the belt feeding device is not readily dismounted from the apparatus main assembly.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent No. 2018-108093 filed on Jun. 5, 2018, Na 2018-118301 filed on Jun. 21, 2018, and Na 2018-118715 filed on Jun. 22, 2018, which are hereby incorporated by reference herein in their entirety.

What is claimed is:

1. An image forming apparatus comprising:

an image forming portion configured to form a toner image;

a belt unit including a rotatable belt onto which the toner image formed by said image forming portion is transferred, said belt unit being detachably provided in said image forming apparatus, wherein said belt unit includes a steering unit including a steering roller configured to stretch said belt, receiving members provided contactable with said belt at each of opposite sides of said steering roller and configured to receive force from said belt by contact with said belt, and a supporting member configured to inclinably support said steering roller and said receiving members, wherein, in a case in which said belt deviates to either side in the width direction of said belt, said belt makes the steering roller incline in a direction to make said belt move toward the other side in the width direction of said belt by the force;

a cleaning unit provided in said steering unit and configured to remove toner remaining on said belt, said cleaning unit being provided with a discharge opening through which toner removed from said belt is discharged to an outside of said cleaning unit;

a receiving opening through which the toner discharged through said discharge opening is received;

a tube-shaped portion provided in said image forming apparatus and configured to establish communication between said discharge opening and said receiving opening, said tube-shaped portion being constituted by a bellows-shaped elastic member capable of expansion and contraction with movement of said steering unit;

an engaging portion provided on said tube-shaped portion and mountable to said cleaning unit when said belt unit is mounted in said image forming apparatus and dismountable from said cleaning unit when said belt unit is dismounted from said image forming apparatus; and a supporting member movably supporting said engaging portion with respect to a predetermined direction crossing a mounting direction of said belt unit, wherein said engaging portion is configured to move to a position where said engaging portion is engageable with said cleaning unit along the predetermined direction in contact with said cleaning unit when said belt unit is mounted.

2. An image forming apparatus comprising:

an image forming portion configured to form a toner image;

a belt unit including a rotatable belt onto which the toner image formed by said image forming portion is transferred, said belt unit being detachably provided in said image forming apparatus, wherein said belt unit includes a steering unit including a steering roller configured to stretch said belt, receiving members provided contactable with said belt at each of opposite sides of said steering roller and configured to receive force from said belt by contact with said belt, and a supporting member configured to inclinably support said steering roller and said receiving members, wherein, in a case in which said belt deviates to either side in the width direction of said belt, said belt makes the steering roller incline in a direction to make said belt move toward the other side in the width direction of said belt by the force;

a cleaning unit provided in said steering unit and configured to remove toner remaining on said belt, said cleaning unit being provided with a discharge opening through which toner removed from said belt is discharged to an outside of said cleaning unit;

a receiving opening through which the toner discharged through said discharge opening is received;

a tube-shaped portion provided in said image forming apparatus and configured to establish communication between said discharge opening and said receiving opening, said tube-shaped portion being constituted by a bellows-shaped elastic member capable of expansion and contraction with movement of said steering unit;

an engaging portion provided on said tube-shaped portion and mountable to said cleaning unit when said belt unit is mounted in said image forming apparatus and dismountable from said cleaning unit when said belt unit is dismounted from said image forming apparatus, and a guiding portion provided in a main assembly of said image forming apparatus and configured to guide said steering unit, wherein said guiding portion guides said steering unit until said engaging portion engages with said tube-shaped portion.

3. An image forming apparatus according to claim 2, wherein said guiding portion is configured to change, with a mounting operation of said belt unit, a pivot angle of said steering unit to an angle at which said cleaning unit and said engaging portion are contactable to each other.

4. An image forming apparatus according to claim 3, wherein said guiding portion is provided on each of opposite sides of said belt unit with respect to the width direction of the belt, and wherein said guiding portion, on the side where said discharge opening is provided with respect to the width direction of the belt, is configured to eliminate support thereof before said cleaning unit contacts said engaging portion.

5. An image forming apparatus comprising:

an image forming portion configured to form a toner image;

a belt unit including a rotatable belt onto which the toner image formed by said image forming portion is transferred, said belt unit being detachably provided in said image forming apparatus, wherein said belt unit includes a steering unit including a steering roller configured to stretch said belt, receiving members provided contactable with said belt at each of opposite sides of said steering roller and configured to receive force from said belt by contact with said belt, and a supporting member configured to inclinably support said steering roller and said receiving members, wherein, in a case in which said belt deviates to either side in the width direction of said belt, said belt makes the steering roller incline in a direction to make said belt move toward the other side in the width direction of said belt by the force;

a cleaning unit provided in said steering unit and configured to remove toner remaining on said belt, said cleaning unit being provided with a discharge opening through which toner removed from said belt is discharged to an outside of said cleaning unit;

a receiving opening through which the toner discharged through said discharge opening is received; and a tube-shaped portion provided in said image forming apparatus and configured to establish communication between said discharge opening and said receiving opening, said tube-shaped portion being constituted by a bellows-shaped elastic member capable of expansion and contraction with movement of said steering unit, wherein a spring constant of said bellows-shaped elastic member is 0.098 N/mm or less.

6. An image forming apparatus comprising:

an image forming portion configured to form a toner image;

a belt unit including a rotatable belt onto which the toner image formed by said image forming portion is transferred, said belt unit being detachably provided in said image forming apparatus, wherein said belt unit includes a steering unit including a steering roller configured to stretch said belt, receiving members provided contactable with said belt at each of opposite sides of said steering roller and configured to receive force from said belt by contact with said belt, and a supporting member configured to inclinably support said steering roller and said receiving members, wherein, in a case in which said belt deviates to either side in the width direction of said belt, said belt makes the steering roller incline in a direction to make said belt move toward the other side in the width direction of said belt by the force;

a cleaning unit provided in said steering unit and configured to remove toner remaining on said belt, said cleaning unit being provided with a discharge opening through which toner removed from said belt is discharged to an outside of said cleaning unit;

a receiving opening through which the toner discharged through said discharge opening is received; and a tube-shaped portion provided in said image forming apparatus and configured to establish communication between said discharge opening and said receiving opening, said tube-shaped portion being constituted by a bellows-shaped elastic member capable of expansion and contraction with movement of said steering unit, wherein said steering roller is pivotable between a first pivot angle and a second pivot angle, and wherein in the case in which a pivot angle of said steering roller is the first pivot angle, said steering unit receives a force from said tube-shaped portion in a direction in which said steering roller moves toward the second pivot angle, and in the case in which the pivot angle of said steering roller is the second pivot angle, said steering unit receives a force from said tube-shaped portion in a direction in which said steering roller moves toward the first pivot angle.

* * * * *